US010393456B1

(12) United States Patent
Beardsley

(10) Patent No.: US 10,393,456 B1
(45) Date of Patent: Aug. 27, 2019

(54) MULTI-COCKING HANDLE CHARGER FOR FIREARMS

(71) Applicant: Christopher C Beardsley, Bardwell, KY (US)

(72) Inventor: Christopher C Beardsley, Bardwell, KY (US)

( * ) Notice: Subject to any disclaimer, the term of this patent is extended or adjusted under 35 U.S.C. 154(b) by 0 days.

(21) Appl. No.: 15/291,923

(22) Filed: Oct. 12, 2016

(51) Int. Cl.
*F41A 3/72* (2006.01)

(52) U.S. Cl.
CPC ..... *F41A 3/72* (2013.01)

(58) Field of Classification Search
CPC ..... F41A 3/72; F41A 35/06; F41C 27/00
USPC ..... 89/1.4, 1.42; 42/16, 90
See application file for complete search history.

(56) References Cited

U.S. PATENT DOCUMENTS 2,832,165 A 4/1958 Ivy
5,179,245 A 1/1993 Straka
7,231,861 B1 6/2007 Guany et al.
D636,043 S * 4/2011 Olsen ..... D22/108
8,567,301 B1 * 10/2013 Sharron ..... F41A 35/06 89/1.4
8,863,632 B1 * 10/2014 O'Malley ..... F41A 3/72 42/16
9,354,014 B2 * 5/2016 Swadener ..... F41A 3/72
9,746,263 B2 * 8/2017 Hillman ..... G01N 15/06
2014/0068988 A1 * 3/2014 Donahue ..... F41A 3/72 42/69.01
2014/0345444 A1 * 11/2014 Hillman ..... G01N 15/06 89/1.4
2016/0018181 A1 * 1/2016 Swadener ..... F41A 35/06 42/90

* cited by examiner

*Primary Examiner* — Jonathan C Weber
(74) *Attorney, Agent, or Firm* — Jacob W Neu; Bradley Arant Boult Cummings LLP

(57) ABSTRACT

A multi-cocking handle charger for a rifle is disclosed. The charger has a bolt actuator constructed to securely mount to a forward, commercial or military floating rail-type foregrip mount. The bolt actuator includes a bracket, an auxiliary charging handle, and an actuator. The auxiliary charging handle is attached to the actuator and is housed within the actuator bracket. A secondary bolt actuator may be mounted along the side of upper receiver of the rifle. The secondary bolt actuator also has an actuator bracket and an actuator. The secondary bolt actuator bracket may be mounted along the side of the rifle's upper receiver in-line with the primary bolt actuator. The secondary actuator front end attaches to or contacts the primary actuator. The rear end of the secondary actuator contacts the primary charging handle in the upper receiver of the rifle.

5 Claims, 24 Drawing Sheets

MULTI-COCKING HANDLE CHARGER FOR FIREARMS

FIELD OF INVENTION

The invention relates generally to firearms, and modifications to or accessories for use with firearms.

BACKGROUND

The AR15 and other similarly designed rifles are used extensively in both civilian and military roles. The AR15 is lightweight, shoulder-held, magazine-fed, gas operated, and air-cooled. Depending upon the model, it is manufactured with the capability of firing either in a semiautomatic mode or in a selective-fire mode.

For the operator to be effective when using an AR15-type rifle, they need to maintain concentration and complete control. To help keep the user's concentration level and control high, the operator must control specific functions of the rifle's operation when the rifle is in the firing position. With this in mind, the AR15 has some specific design shortcomings that interrupt this control and concentration, causing the operation of the rifle to be less than fluid.

One of the main control parts of the rifle is the pistol grip. The operator uses the dominant hand to control the movement of the firearm and also to fire it. As stated, the AR15-type rifle has some design shortcomings that are apparent when correcting malfunctions with ammunition and especially when cocking the bolt. In many cases, correcting malfunctions requires the operator to perform actions that reduce user control and concentration.

One action used to correct an ammunition malfunction, while in the firing position, is for the operator to remove his or her dominant hand from the pistol grip to actuate the rifle's cocking handle.

Another common corrective action involves removing the whole rifle from the operator's shoulder and away from the firing position. Once removed, the operator uses the opposite hand, which was controlling the forward portion of the rifle, to actuate the charging handle to correct the malfunction.

As a result of making these required movements to correct such malfunctions, the hand and body make large shifts from place to place, negatively impacting the operator's physical and mental control and concentration. Either of these actions, especially when done in certain stressful situations, can have many negative consequences. Not only is it greatly distracting to the operator, but it costs valuable time and reduces user effectiveness.

While modifications are known, none solve the aforementioned problem with AR15 rifles. When examining these prior-art firearm modifications one has to look at the environment in which they are being used. Generally the types of firearms these modifications will be attached to are military or military-style rifles. Since the military and their equipment operate in harsh environments the prior art firearm modifications are also expected to work in harsh environments. Thus the firearm and its modification must work as intended or else, as stated earlier, the concentration and control of the user is negatively affected.

SUMMARY OF THE INVENTION

In accordance with one embodiment, a multi-cocking handle charger for a rifle is rugged and functional and comprises an assembly of parts that can be added to different areas of a rifle to provide an auxiliary charging handle for the rifle. The operator can then actuate the primary charging handle to cock the bolt of the rifle from an auxiliary position. This allows independent and unimpeded operation of the original mechanisms or parts of the rifle to which it is added. The actuating mechanism is guided and protected by a rugged housing so that any unimpeded movement allows the rifle's recoil buffer spring(s) to return the actuating mechanism to its home position. This allows the operator to be more effective.

Figure 1:
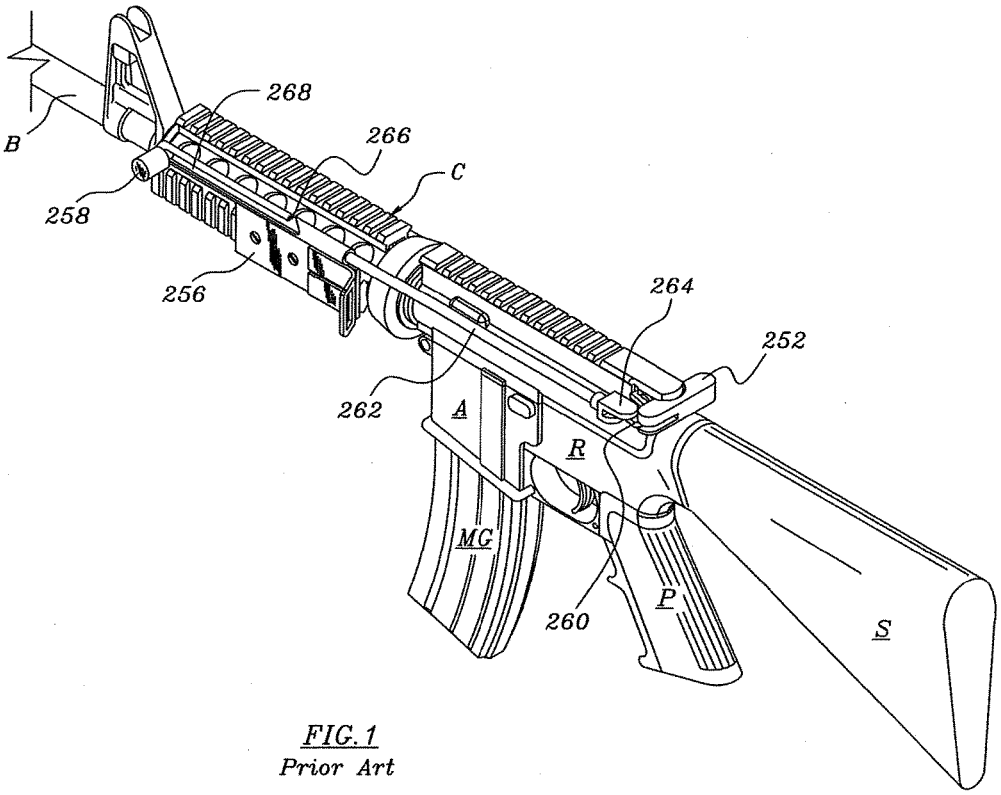
FIG. 1 Prior Art
FIG. 1 is a left perspective view of a prior-art firearm with a modification assembly for actuating the primary charging handle of an AR15 type rifle.

A key for the reference numerous is provided below:

A—Lower Receiver
B—Barrel
C—Commercial or Military Floating Rail-Type Foregrip Mount
FS—Front Sight
MG—Magazine
P—Pistol Grip
R—Firearm Receiver
S—Stock
UR—Upper Receiver
10—Multi-Cocking Handle Charger
10A—Multi-Cocking Handle Charger
10B—Multi-Cocking Handle Charger
10C—Multi-Cocking Handle Charger
10D—Multi-Cocking Handle Charger
12—Primary Bolt Actuator
14—Modified Foregrip
16—Auxiliary Charging Handle
18—Auxiliary Charging Handle Screw
20—Foregrip Slot
22—Primary Link
24—Primary Bolt Actuator Bracket
26—Lower Coupling Screw
28—Coupling Bracket
30—Secondary Bolt Actuator Bracket

32—Secondary Link Slot
34—Secondary Link
36—Primary Charging Handle
38—Primary Charging Handle Latch
40—Stock Bracket
42—Stock Bracket Pin
44—Upper Retaining Screw
46—Set Screw
48—Forward Threaded Bore in Primary Bolt Actuator Bracket
50—Mounting Slot
52—Back Rear Portion of Primary Bolt Actuator Bracket
54—Side front portion of accessory mount boss
56—Forward portion of Primary Bolt Actuator Bracket
58—Primary Link Slot
60—Countersunk Bore
62—Alternative Link
64—Rear opening of mating profile for accessory mount
68—Forward portion of accessory mount
70—Forward portion of Secondary Bolt Actuator Bracket
72—Rear portion of Secondary Bolt Actuator Bracket
74—Lower threaded bores
76—Forward portion of Secondary Link
78—Secondary Link Catch
82—Rear portion of Sec. Link Slot in Sec. Bolt Actuator Brkt.
86—Rear threaded bores of Primary Link
88—Front-end portion of Primary Link
90—Forward Primary Link Threaded Bore
92—Rear-end portion of Auxiliary Charging Handle
96—Auxiliary Charging Handle Bore
98—Lower Coupling Bore(s)
100—Upper Coupling Bore
102—Threaded boss bore
104—Pin
106—Upper Receiver Slot for Primary Charging Handle
108—Front portion of Primary Charging Handle
112—Small bore in Stock Bracket
114—Rear portion of Lower Receiver
116—Rear Retaining Bore
120—Threaded portion of Stock Buffer Tube
122—Rear threaded portion of Lower Receiver
124—Stock Nut
126—Alternative Bolt Actuator Bracket
128—Front Pivot Pin
130—Front Pivot Pin Retaining Screw
132—Alternative Bracket lower Bore
134—Inside Bore
136—Outside bore
138—Cylindrical Shank of Front Pivot Pin
140—Threaded Bore
142—Right side lower receiver bore
144—Alternative Coupling Bracket
146—Alternative Coupling Bracket Upper Bore(s)
148—Lower Bore
150—Guide Pin Threaded Bore
152—Guide Pin
156—Coupling Bracket Screw(s)
158—Guide Pin Slot
160—Front Boss Threaded Bore(s)
162—Alternative Link Boss
164—Alternative Link Boss Slot
166—Rear Portion of Alternative Link Slot
170—Forward portion of Alternative Link
172—Modified Receiver
174—Modified Rail-Type Mount
176—Integrated Receiver
178—Barrel Retaining Screw(s)
180—Side Accessory Mount
186—Retaining Spring
190—Barrel Retaining Screw Bore(s)
192—Accessory Mounting Boss
194—Undercut Retaining Screw
196—Secondary Bolt Actuator
198—Delta Ring
200—Debris Hole
202—Front clearance cut—Primary Bolt Actuator Bracket
204—Back clearance cut—Primary Bolt Actuator Bracket
206—Forward Boss
208—Link Body
210—Catch Slot
212—Rear clr. cut—Sec. Bolt Act. Brkt. for Sec. Link Catch
214—Protruding Boss
216—Corner Radius Pocket
218—Angled Surface of Alternative Bolt Actuator Bracket
220—Accessory Mounting Notch(es)
222—Steel Body
224—Threaded shaft of Auxiliary Charging Handle Screw
226—Primary Charging Handle Gripping Points
228—Hooked portion of Primary Charging Handle Latch
230—Formed Plastic Gripping Portion
232—Primary Charging Handle Latch Boss
234—Stock Bracket Boss
236—Stock Buffer Tube
238—Non-modified Foregrip
240—Alternative Bolt Actuator
242—Domed Retaining Head
244—Integrated Alternative Bolt Actuator
248—Accessory Mount
250—Mating Profile
252—Standard Charging Handle
256—Firearm Modification Assembly
258—Cocking Handle
260—Charging Handle Latch
262—Operating Rod
264—Rod Connector
266—Locking Notch
268—Cocking Handle Operation Slot
270—Recoil Buffer Spring
272—Forward Actuation Point
274—Rear Actuation Point

DETAILED DESCRIPTION

First Embodiment

Figure 2:
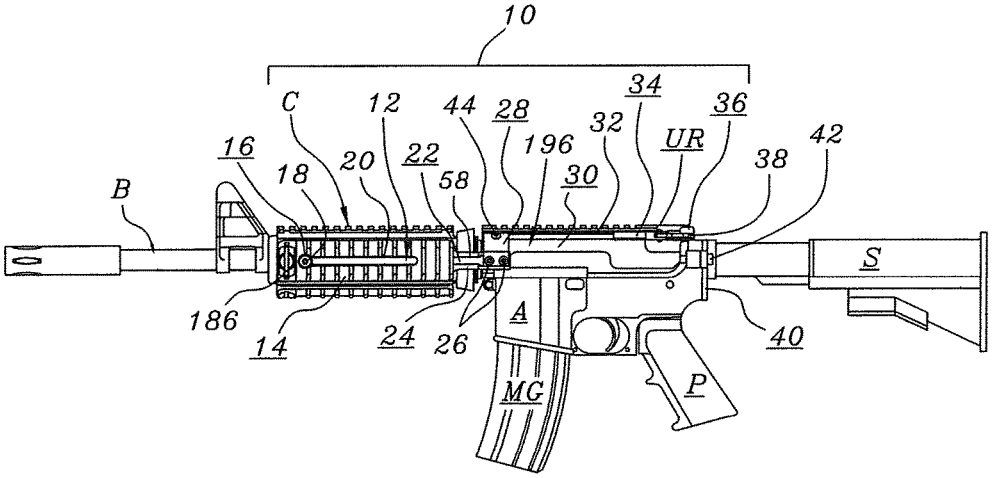
FIGS. 2 through 2I are left elevation, left perspective, cross-section, and general detail views, in both exploded and assembled representations, respectively, of one aspect of a first embodiment of an AR15 type rifle with a modification for actuating the primary charging handle or bolt of a firearm.
Figure 2A:
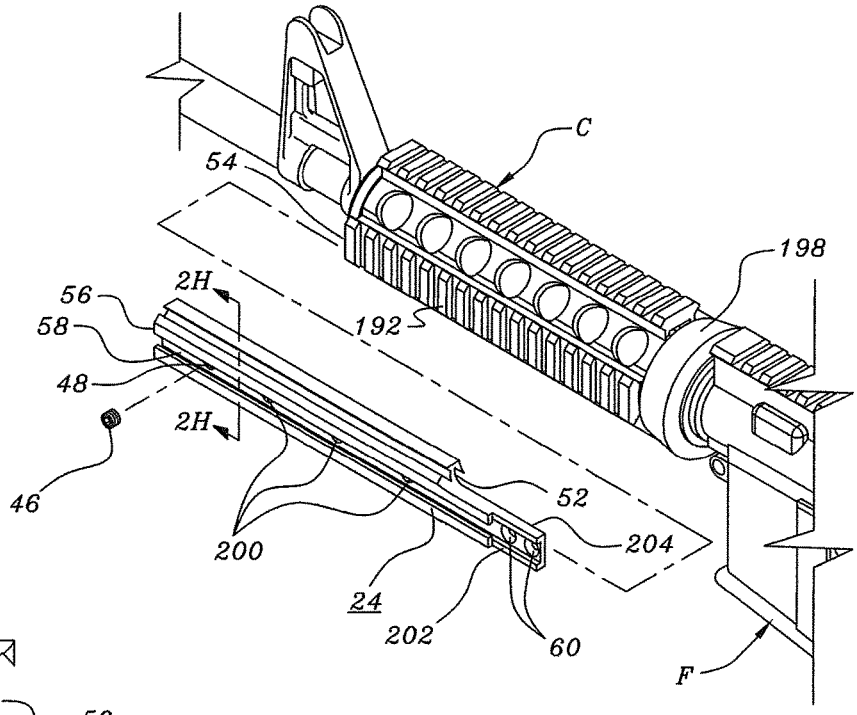
Figure 2H:
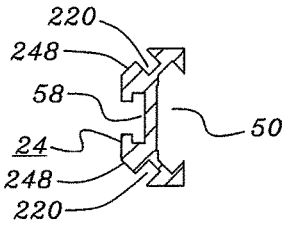
Figures 2B, 2I:
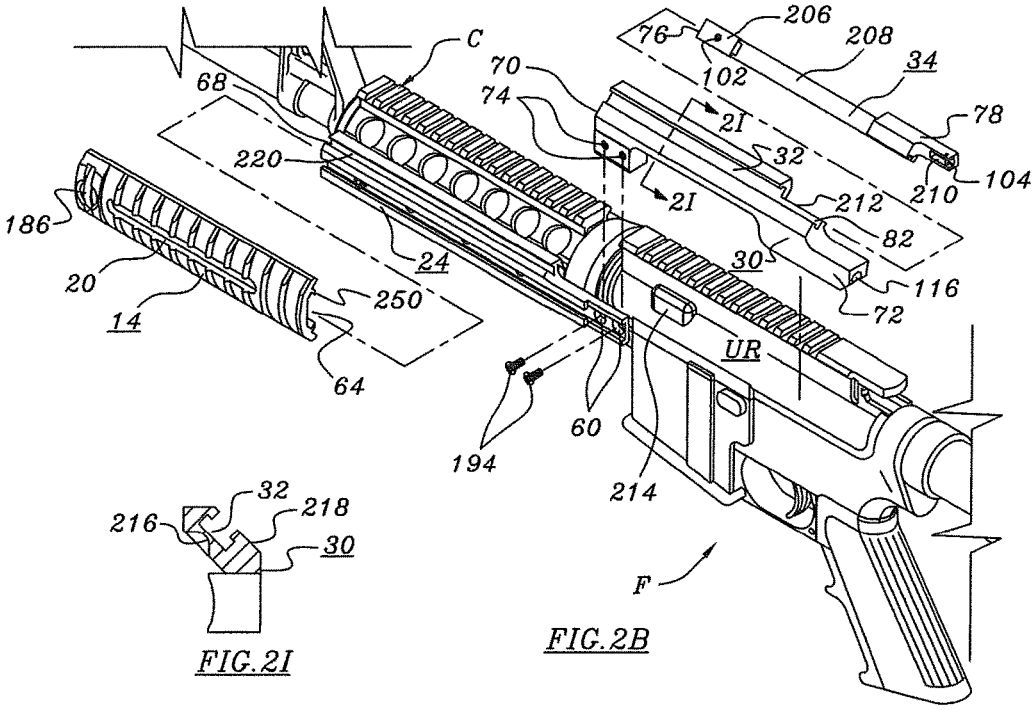
Figure 2C:
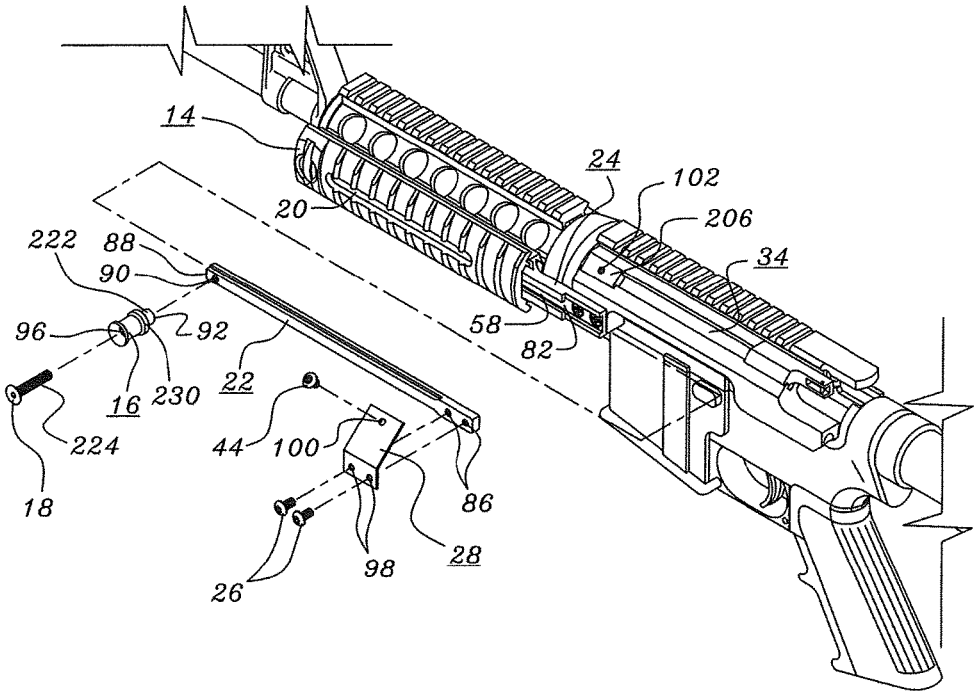
Figure 2D:
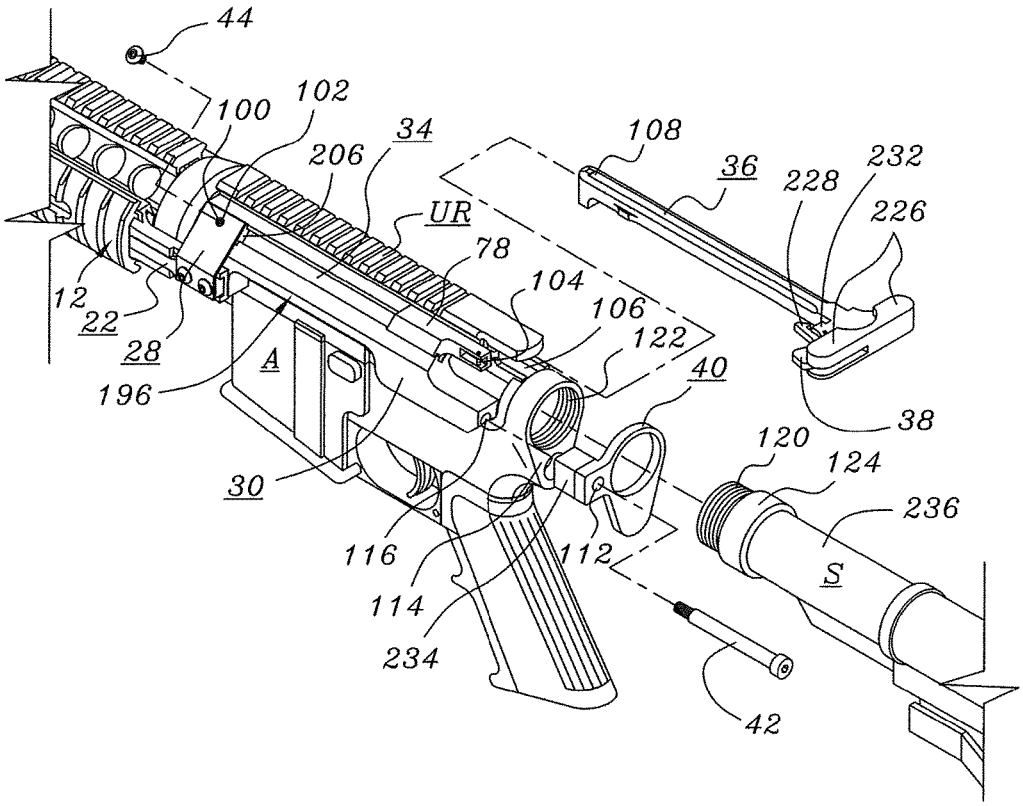
Figure 2E:
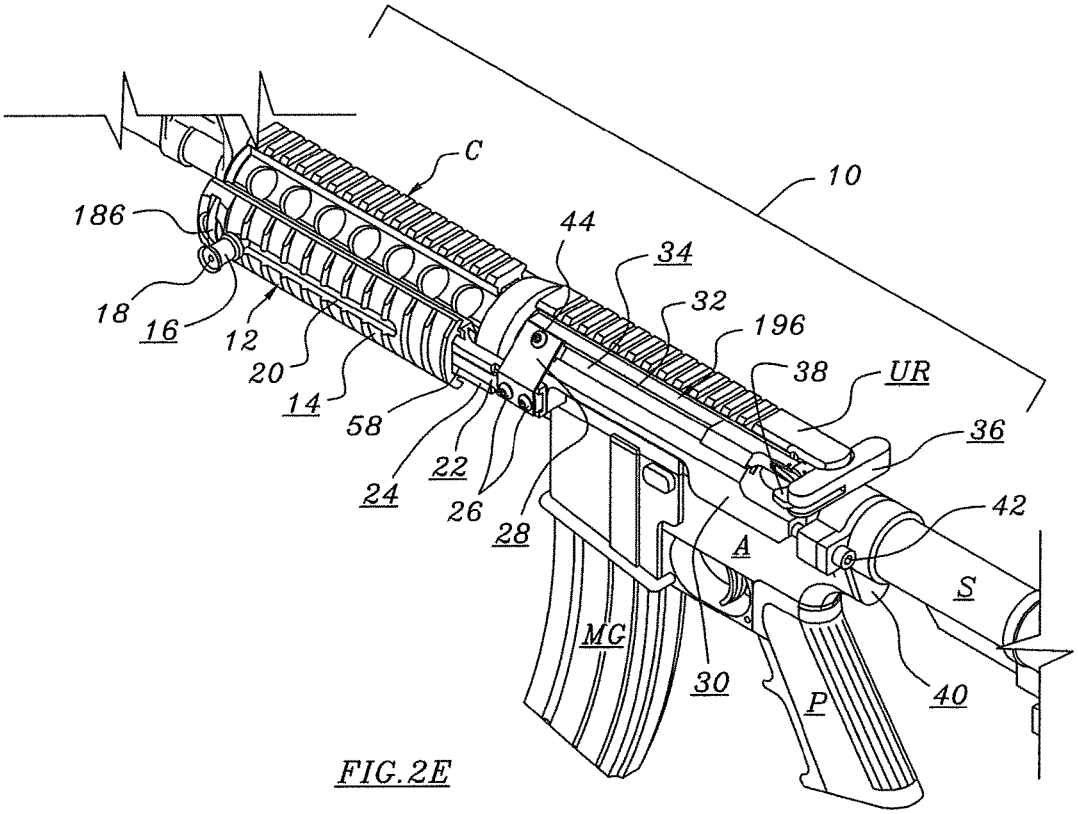

FIGS. 2 and 2E show a first embodiment of an AR15-type rifle having a stock S, a pistol grip P, a lower receiver A having an ammunition magazine MG, an upper receiver UR, a barrel B, and a commercial or military floating-rail-type foregrip mount C. This rifle is operated by positioning pistol grip P firmly in the dominant hand and placing the opposite hand on the forward, rail-type mount C. The forward hand is then removed from mount C and moved to the rear of upper receiver UR to cock or charge the bolt of the rifle.

Cocking the bolt is performed by grasping a standard charging handle (not shown) located at the rear of upper receiver UR and pulling rearward. As the rearward force is applied, the charging handle pulls a bolt (not shown) housed within upper receiver UR rearward also. The rearward action cocks the bolt. When the rearward force is released, both the handle and the bolt return home from a force applied to the bolt by a recoil spring (not shown) housed in stock S. As the bolt returns home it picks up a single round of ammunition stacked in an ammunition magazine MG housed in lower receiver A. Continuing into its home position, the bolt pushes the round of ammunition forward into the chamber (not shown) of barrel B where it can now be fired.

FIG. 2 is a left elevation view and FIG. 2E is a left perspective view of the rifle and a multi-cocking handle charger 10. Charger 10 includes the following components: a primary bolt actuator 12 and a secondary bolt actuator 196. Both are used to transfer energy from the operator to a primary charging handle 36. Handle 36 replaces standard charging handle 252 and is used for cocking the rifle.

Bolt actuator 12 is an assembly of parts mounted to the forward end of the rifle by a primary bolt actuator bracket 24. Bracket 24 is a slender, low-profile, rectangular mounting bracket that also guides a cylindrical handle 16. Handle 16 is mounted to the front of a long, rectangular primary link 22 housed in bracket 24. Link 22 moves within bracket 24, transferring linear energy from handle 16 to secondary actuator 196. Link 22 is connected to actuator 196 by a rectangular, sheet metal coupling bracket 28 located at the rear of link 22.

Actuator 196 is an assembly of parts mounted to the midsection of the rifle by a rectangular, low-profile, secondary bolt actuator bracket 30. Bracket 30 also houses and guides a long, rigid, rectangular secondary link 34. Link 34 is connected at its front end to actuator 12 by bracket 28. The rear of link 34 rests against a T-shaped, handle 36 housed within upper receiver UR. Link 34 moves within bracket 30 to continue the transfer of linear energy from handle 16 to handle 36.

With actuator 12 and actuator 196 in location two cocking handles are available. At the front of the rifle, handle 16 is used to transfer linear energy from the operator to handle 36. Rearward force applied to handle 16 is transferred through assemblies actuator 12 and actuator 196 to handle 36. The transferred energy moves handle 36 rearward cocking the bolt. To the rear, handle 36 can be pulled independently from handle charger 10 to cock the bolt. Either handle can be used to cock the bolt of the rifle.

In further detail, FIGS. 2 and 2E show the rifle having a stock S, a pistol grip P, a lower receiver A having an ammunition magazine MG, an upper receiver UR, a barrel B, and a commercial or military floating-rail-type foregrip mount C. The rifle is operated by positioning pistol grip P firmly in the dominant hand and placing the opposite hand on the forward, rail-type mount C. Then the forward hand is removed from mount C and moved to the rear of upper receiver UR to cock or charge the rifle.

FIG. 2 is a left elevation view and FIG. 2E is a left perspective view of the rifle and charger 10. Charger 10 includes the following components: a primary bolt actuator 12 and a secondary bolt actuator 196. Both are used to transfer energy from the operator to a primary charging handle 36.

Primary bolt actuator bracket 24 is arranged to hold primary actuator 12 and the following components: an auxiliary charging handle 16 for transferring energy from the operator to charger 10, a primary link 22 for linearly transferring energy from handle 16 to secondary actuator 196, and a coupling bracket 28 for joining link 22 to a secondary actuator 196.

Secondary actuator 196 is mounted between mount C and handle 36 of the rifle. Actuator 196 couples the linear movement from the operator to its final destination, handle 36. Actuator 196 consists of a secondary bolt actuator bracket 30 which houses secondary link 34 arranged to further transfer linear energy from handle 16 to handle 36.

Primary bracket 24 has a slender, rectangular shape and supports and guides primary link 22 by a matching longitudinal, primary link slot 58 (FIG. 2C). Coupling bracket 28 is a thin, rectangular bracket attached to the rear end portion of link 22 by two spaced lower coupling screws 26 (FIG. 2C) and is used to couple link 22 to link 34.

Modified foregrip 14 is a rectangular molded, foregrip which is attached to an accessory mount 248 formed longitudinally into primary bracket 24 (FIG. 2B). With foregrip 14 in place it serves as a hand placement or gripping point for the operator.

Foregrip 14 has a profile that mates with accessory mount 248 formed into its backside, and slides in accessory mount 248. Foregrip 14 is then held in place on primary bracket 24 by a retaining spring 186 (FIG. 2B).

Foregrip 14 contains a longitudinal foregrip slot 20, which allows the installation and operation of an auxiliary handle 16.

Handle 16 is shown in its home position, fastened to the forward portion of link 22 by an auxiliary charging handle screw 18 (FIG. 2C). Handle 16 is a forward, auxiliary charging handle or grip for the operator to cock the rifle by transferring energy from the operator to handle 36.

Secondary actuator 196 (FIGS. 2 and 2E) is mounted in position along an upper receiver UR of the rifle by two mechanical connections. The first connection is made by connecting the rear end portion of primary bracket 24 to forward portion of a low profile, rectangular secondary bracket 30 (FIG. 2B). These two components are connected with two, undercut retaining screws 194 (FIG. 2B). After primary bracket 24 and secondary bracket 30 have been joined, a second mechanical connection is made at the rear portion of secondary bracket 30 (FIG. 2D). This connection is made to help rigidly secure charger 10 to the rifle.

The second mechanical connection is made by a rear-retaining bore 116 (FIG. 2B), a stock bracket 40, and a stock-bracket pin 42.

FIGS. 2 and 2E show how secondary bracket 30 and a longitudinal, T-shaped secondary link slot 32 supports and guides the cross-section of secondary link 34. Housed within secondary slot 32, link 34 is connected at its forward portion by coupling bracket 28 and also by an upper retaining screw 44. This mechanical connection couples primary link 22 to secondary link 34, allowing linear movement to transfer from actuator 12 to actuator 196.

A T-shaped handle 36 is held in place against rear portion of link 34 by a spring-loaded, hook-shaped primary charging handle latch 38 mounted within handle 36. Latch 38 engages a pin 104 (FIG. 2B), which is installed in the rear portion of link 34. Latch 38 holds handle 36 in location (FIG. 2D) while in operation or rest.

FIG. 2A is a left perspective, exploded view of primary bracket 24. In this view an enlarged exploded view of the front portion of the rifle and primary bracket 24 is shown in its entirety.

FIG. 2H is an enlarged sectional view of primary bracket 24 of FIG. 2A taken at the sectioning plane and in the direction indicated by section lines 2H-2H. Features shown by section line 2H-2H include a mounting slot 50, a primary link slot 58, and an accessory mount 248. Slot 50 is a dovetail-shaped slot formed on the back side of primary bracket 24 for attachment to mount C or other mounts that may be available. Slot 50 is starts at the front end portion of bracket 24 and continues down the longitudinal centerline. It continues to an opening at the front and the rear end portions of bracket 24. Slot 50, in bracket 24, matches any mating accessory mount-shaped bosses 192 on mount C.

A primary slot 58 is located on the front side of primary bracket 24. Slot 58 is a T-shaped, longitudinal, slot formed continuously along the front, centerline of bracket 24. Slot 58 is fabricated at predetermined dimensions along the centerline of bracket 24 to provide support for link 22 (FIGS. 2, 2E, and 2C).

The last notable feature in FIG. 2H is accessory mount 248, which is formed in the front side of primary bracket 24. Accessory mount 248 is a longitudinal, dovetail-shaped profile formed by milling two narrow, continuous, angular, accessory mounting notches 220 into a pre-formed rectangular block of rigid material. Notch 220 is formed at a predetermined distance from the front edge of the block. Once first notch 220 is formed, a second notch 220 is formed in the same manner on the opposite side of bracket 24.

After forming notches 220, two chamfer cuts at predetermined depths are used to remove the front-top and front-bottom corners from the rectangular material. The removed corners form accessory mount surfaces 248, which is used for a mounting structure.

The steps discussed for performing the milling operations can be done in different sequences than stated.

Also shown in the left perspective view of primary bracket 24 in FIG. 2A are two clearance cuts at its rear portion. A first, back-clearance cut 204 is made to remove material at the back side, rear portion so the rear portion of bracket 24 can clear a delta ring 198 of the rifle when being installed. A second, front-clearance cut 202 is made on the front, rear portion of bracket 24 to remove material for coupling bracket 28 (FIGS. 2 and 2E) so it can be installed without interference (FIG. 2B).

A series of four bores are formed longitudinally down primary slot 58. The bores include a forward threaded bore 48 located at the front portion, three debris bores 200 at the midsection, and two countersunk bores 60 at the rear portion. Threaded bore 48 is spaced from the front edge of bracket 24 along its centerline. Threaded bore 48 is a part of a mounting connection used to secure bracket 24 to mount C by a mating set screw 46.

The three spaced debris bores 200 at the midsection of primary bracket 24, seen in slot 58, are for removing or holding debris which may come from the operating environment. Debris bores 200 are fabricated to allow foreign debris to clear slot 58 if necessary.

The last bores at the rear portion of primary link slot 58 are two countersunk bores 60. Bores 60 are located from the rear edge of primary bracket 24, along its centerline and spaced a distance from the outside edges. Countersunk bores 60 will be part of a mechanical connection used to secure primary bracket 24 to secondary bracket 30 (FIG. 2B).

Primary bracket 24 (FIG. 2A) is secured to mount C. The mounting is performed by aligning a rear opening of slot 50 (FIG. 2H), located at a back rear portion 52 of bracket 24, to a matching side front portion 54 of accessory boss 192 on mount C. When the two mounting profiles are aligned, bracket 24 is slid longitudinally along boss 192 of mount C. This is done until front end 56 of bracket 24 is aligned with side front portion 54 of boss 192. When the alignment of the two front ends is complete, set screw 46 is placed in bore 48 at the forward portion of primary bracket 24 and tightened. Set screw 46 secures primary bracket 24 to a specific position on mount C.

FIG. 2B is a left perspective, exploded view of a portion of the components used in charger 10. Included in the view are primary bracket 24, secondary bracket 30, secondary link 34, foregrip 14, and undercut retaining screws 194. Primary bracket 24 is shown mounted to mount C.

With bracket 24 in position, foregrip 14 can be mounted. Foregrip 14, in one embodiment, is a commercially available molded, plastic, foregrip that has been modified by an elongated, through, foregrip slot 20 at its longitudinal centerline. This allows the installation and operation of auxiliary handle 16 (FIGS. 2, 2E, and 2C). Foregrip 14 has a mating profile 250 molded directly into the back side of its body.

FIG. 2B shows secondary bracket 30 of charger 10. Secondary bracket 30 is formed of rigid material having a low profile and basic rectangular shape and cross section.

FIG. 2I shows an enlarged sectional view of secondary bracket 30 of FIG. 2B taken at the sectioning plane and in the direction indicated by section lines 21-21. Features shown by section line 21-21 of bracket 30 include an angled surface 218, secondary slot 32, and a corner radius pocket 216.

Angled surface 218 is located to the front of the section line 21-21 and is formed by chamfer milling the front top corner of the rectangular cross section. This chamfer is a continuous longitudinal cut made at a distance from the front edge of the material. The cut helps to bring the overall profile of secondary bracket 30 closer to the original profile of the rifle to streamline the design.

Next (FIG. 2I) secondary slot 32 is formed into angled surface 218 of secondary bracket 30. Secondary slot 32 is a continuous T-shaped slot formed longitudinally along angled surface 218. Slot 32 creates an opening at the front and rear of bracket 30. Slot 32 also guides and supports secondary link 34.

A third feature shown in FIG. 2I is corner radius pocket 216, which allows clearance for a protruding boss 214 in upper receiver UR of the rifle. Pocket 216 is formed by milling material from the back side of secondary bracket 30. The material is removed to match the protruding boss 214 at the forward portion of upper receiver UR of the rifle. The removal of the material allows secondary bracket 30 to closely fit the profile of upper receiver UR once mounted.

At rear portion 72 (FIG. 2B) of secondary bracket 30 is a rear clearance cut 212 and rear bore 116. Cut 212 is formed by removing material from secondary bracket 30. This makes clearance for a secondary link catch 78.

Also seen in the rear, lower portion of secondary bracket 30 is rear bore 116, which is formed to correspond with the dimensions of stock pin 42 (FIG. 2D), with the exception of the diameter which is approx. 0.025 mm to 0.050 mm larger (FIG. 2D).

Located internally at the end of rear bore 116 is a threaded bore (not shown). This is used to secure stock pin 42 (FIG. 2D) in place.

The front lower portion of secondary bracket 30 has two lower threaded bores 74. These are formed into the front lower portion of secondary bracket 30 to accommodate undercut screws 194. Lower bores 74 are formed with the mating threads for screws 194, which are used in the mechanical connection of primary bracket 24 and secondary bracket 30.

FIG. 2B also shows secondary link 34, which has a long, thin rectangular shape, and is formed of multiple metal components. The components include, but are not limited to, a forward boss 206, a link body 208, and catch 78.

Forward boss 206 is a rectangular, block of alloy metal having a T-shaped cross section with a threaded boss bore 102 at the top center. Forward boss 206 is located at the front portion of link 34. Forward boss 206 is attached to body 208 by silver solder, welding, riveting, etc. and is used as a fastening point for bracket 28.

Link body 208 is a long, thin rectangular piece of alloy metal bar stock of a predetermined length and cross section. The dimensions of body 208 are made to match secondary slot 32 and body 208 is used as the main supporting structure for the components of link 34.

Catch 78 is a rectangular piece of alloy metal having a rectangular catch slot 210. Slot 210 is located at the centerline of the rear portion of catch 78. Slot 210 is approximately 0.508 mm wider than the dimensions of a hooked portion 228 (FIG. 2D) of latch 38 (FIG. 2D). Also, a pin 104 is inserted in the rear-forward portion of catch slot 210. Catch 78 is attached to body 208 by silver solder, welding, riveting, etc.

Pin 104 is a cylindrical rigid pin which has been installed vertically at a predetermined distance from the rear and forward edges of catch 78. Pin 104 is used as an engaging point for latch 38 so link 34 and handle 36 stay together while in motion or at rest.

Secondary bracket 30 (FIG. 2B) is installed as follows: Pocket 216 at the forward, back portion of secondary bracket 30 is aligned with protruding boss 214 at the forward-side portion of upper receiver UR. Secondary bracket 30 is further positioned by aligning lower bores 74 in the forward lower portion of secondary bracket 30. Lower bores 74 are aligned with the two countersunk bores 60 of primary bracket 24, which is already mounted to mount C. Undercut screws 194 are inserted through countersunk bores 60 of bracket 24 and threaded into lower bores 74 of bracket 30. Undercut screws 194 are tightened to form a mechanical connection.

Foregrip 14 is mounted to primary bracket 24 by aligning a rear opening 64 of mating profile 250 molded into the back of foregrip 14, with a forward portion 68 of accessory mount 248 machined into bracket 24. Foregrip 14 is then guided into place along bracket 24 by sliding it along longitudinal notches 220 until retaining spring 186 engages the foregrip retaining notch (not shown) formed into bracket 24.

Secondary link 34 is installed into secondary slot 32 by aligning a forward portion 76 of link 34 with a rear portion 82 of slot 32. Link 34 is then slid along slot 32 until forward portion 76 of forward boss 206 of link 34 is flush with a forward portion 70 of secondary bracket 30.

FIG. 2C is a left perspective, exploded view of a portion of the components used in charger 10. FIG. 2C is an enlarged exploded view, which includes primary link 22, coupling bracket 28, and auxiliary handle 16.

Primary link 22 is a long thin rectangular piece of alloy metal, bar stock of a predetermined length, having a T-shaped cross section. The dimensions of link 22 match those of primary slot 58. Link 22 has located along its centerline and a front-end portion 88, a forward primary link threaded bore 90.

Front bore 90 is threaded to match a threaded shaft 224 of auxiliary screw 18. At the opposite end of link 22 are two spaced, threaded bores 86 on its centerline. These threads match those of a threaded shaft of lower coupling screws 26.

Coupling bracket 28 is a rectangular piece of formed, sheet metal with the lower portion having two spaced, round, lower coupling bores 98. Lower bores 98 are formed approximately 0.254 mm larger in diameter than those matching the dimensions of threaded bores 86 on link 22.

The upper portion of coupling bracket 28 is formed at a 45° angle with a single, round, upper coupling bore 100. Upper bore 100 is located at a predetermined place to match the center location of threaded bore 102 of link 34. Upper bore 100 is approximately 0.254 mm larger in diameter than threaded bore 102.

Auxiliary handle 16 is a cylindrical handle constructed with a formed plastic gripping portion 230 press fit on to a steel body 222.

Body 222 has an auxiliary charging handle bore 96 formed through its centerline approximately 0.254 mm larger in diameter than that of threaded shaft 224 of auxiliary screw 18.

As shown in the left perspective view of the embodiment seen in FIG. 2C, link 22 is installed in position. This is done by aligning its front-end portion 88 with rear portion 82 of the matching T-shaped primary slot 58 of primary bracket 24. Link 22 is then pushed forward until threaded bore 90 located at the front end of link 22 is visible through foregrip slot 20 of foregrip 14.

Auxiliary handle 16 is mounted by placing a rear end 92 of handle 16 into foregrip slot 20. It is then aligned with threaded bore 90 at the front end of link 22, which is visible through slot 20. Handle 16 is secured to link 22 by inserting threaded shaft 224 of auxiliary screw 18 through auxiliary handle bore 96 of handle 16. Screw 18 is turned into threaded bore 90 of link 22 until tight. Handle 16 and link 22 are slid into their home position within primary slot 58, which guides and supports the combined components.

Coupling bracket 28 is mounted in the following manner. Bracket 28 is mounted by aligning the two spaced, lower coupling bores 98 in the lower portion of bracket 28 with the two spaced, threaded bores 86 in the rear end of link 22. Bracket 28 is secured to link 22 by inserting the threaded shaft of bracket screw 26 through lower bore 98. Screw 26 is then tightened. The prior step is repeated until both screws are in place and secured.

After bracket 28 is secured to link 22 by screws 26, it is then secured to secondary link 34. This is done by aligning upper bore 100 with threaded, boss bore 102. Upper bore 100 is on the angled, upper portion of coupling bracket 28. Upper bore 100 is aligned with threaded bore 102 on forward boss 206 of link 34. After upper bore 100 and threaded bore 102 are aligned, they are secured with upper screw 44 (FIG. 2D).

FIG. 2D is a left perspective, exploded view of a portion of the components used in charger 10. FIG. 2D shows the rear portion of the rifle, which includes handle 36, stock bracket 40, and stock pin 42, as discussed in FIG. 2.

Handle 36 is an aluminum T-shaped handle of original design. Handle 36 is located at the rear portion of upper receiver UR. Handle 36 has been modified by adding width to a charging handle latch boss 232. This was done to match the width of the rear end of catch 78. With this modification, width was also added to one side of a gripping point(s) 226. This is done to provide a contact surface for the rear portion of catch 78.

FIG. 2D also shows stock bracket 40, a thin, egg-shaped bracket made of metal having on one side a thickened, rectangular, stock bracket boss 234. Located on boss 234 is a small bore 112 at a predetermined dimension to match with rear bore 116 of secondary bracket 30, in its installed position.

FIG. 2D shows stock pin 42 as a round, socket-head, alloy metal, shoulder screw with a smooth shoulder of a predetermined length, having a length of the lower shaft threaded. Stock pin 42 is commercially available in supply houses, e.g., McMaster-Carr, Manhattan Supply Company, etc., as a shoulder screw.

FIG. 2D shows handle 36 in location in an originally designed upper receiver slot 106. Handle 36 is installed in position by a rear opening in upper receiver UR by performing a field stripping operation of the rifle (not shown). With upper receiver slot 106 exposed by the field stripping operation, a front portion 108 of handle 36 is inserted into rear portion of upper receiver slot 106. After inserting, handle 36 is pushed into its forward, home position by completing the remainder of the field stripping operations. A hooked portion 228 of latch 38 then engages a vertically mounted pin 104. Pin 104 is located in catch 78 of link 34 and provides a coupling point for handle 36 to link 34 as discussed in connection with FIG. 2.

FIG. 2D shows the components installed as follows.

Stock bracket 40 is mounted in position by removing stock S from lower receiver A and slipping stock bracket 40 over a threaded portion 120 of a stock buffer tube 236. Stock bracket 40 is oriented so that a stock boss 234 of stock bracket 40 is on the same side as the other previously mounted components of charger 10.

With stock bracket 40 in place on buffer tube 236, threaded portion 120 of buffer tube 236 is reinserted into a rear threaded portion 122 of lower receiver A. Tube 236 is then threaded back into place. Stock bracket 40 is slid forward across buffer tube 236 until it rests against a rear portion 114 of lower receiver A.

With stock bracket 40 in place, a stock nut 124 on threaded portion 120 of buffer tube 236 is then threaded forward along portion 120 of buffer tube 236 until it contacts rear portion 114 of stock bracket 40. Stock nut 124 is then tightened.

With stock bracket 40 secured, stock pin 42 is placed in position by inserting the threaded portion of stock pin 42 through a small bore 112. Bore 112 is on stock boss 234, protruding from stock bracket 40 and is approximately 0.050 mm larger in diameter than stock pin 42. Pin 42 is pushed forward until it enters rear bore 116 of secondary bracket 30. Pin 42 continues forward until it stops. It is then threaded into the mating threads (not shown) at the bottom portion of rear bore 116.

FIG. 2D also shows a connection point of primary actuator 12 and secondary actuator 196 of charger 10. The connection point of actuators 12 and 196 is at an upper angled portion of coupling bracket 28. Bracket 28 has a single upper bore 100.

Coupling bracket 28, as stated, is secured to primary link 22 (FIG. 2C). Bracket 28, having upper bore 100 located on its angled portion, is aligned with boss bore 102 on forward boss 206 of secondary link 34. Upper retaining screw 44 is inserted through coupling bore 100 and threaded into boss bore 102.

Figure 2F:
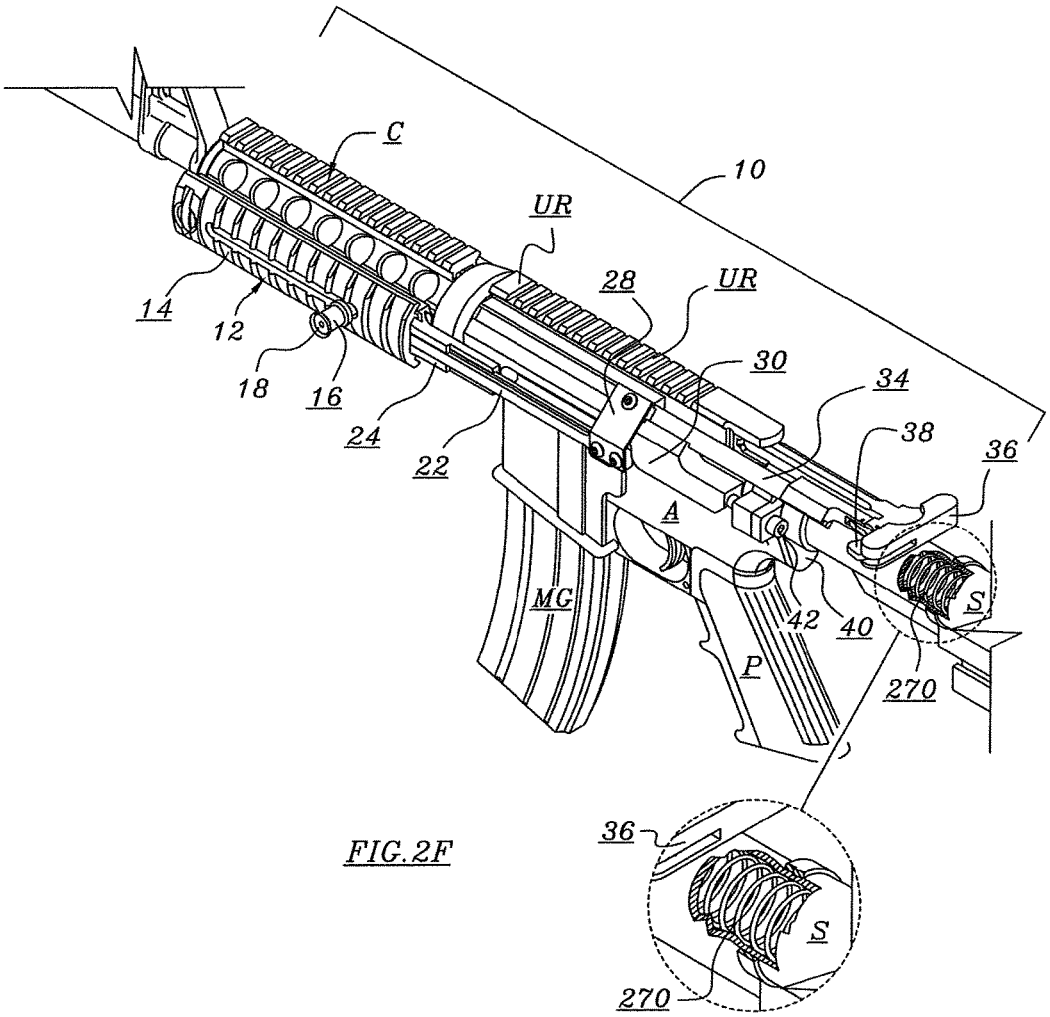

FIG. 2F is a left perspective view illustrating the operation of primary actuator 12 of charger 10. FIG. 2F shows an enlarged view of the rifle with charger 10 installed in its mounted position and handle 36 being moved by auxiliary handle 16.

Charger 10 includes rail-type mount C, lower receiver A, ammunition magazine MG, upper receiver UR, pistol grip P, stock S, and charger 10.

Charger 10 also includes foregrip 14, auxiliary handle 16, auxiliary screw 18, primary bracket 24, primary link 22, coupling bracket 28, secondary link 34, secondary bracket 30, latch 38, handle 36, stock bracket 40, and stock pin 42 (FIG. 2 for more details). In this view, as in FIGS. 2 and 2E, ammunition magazine MG is shown mounted in lower receiver A.

Figure 2G:
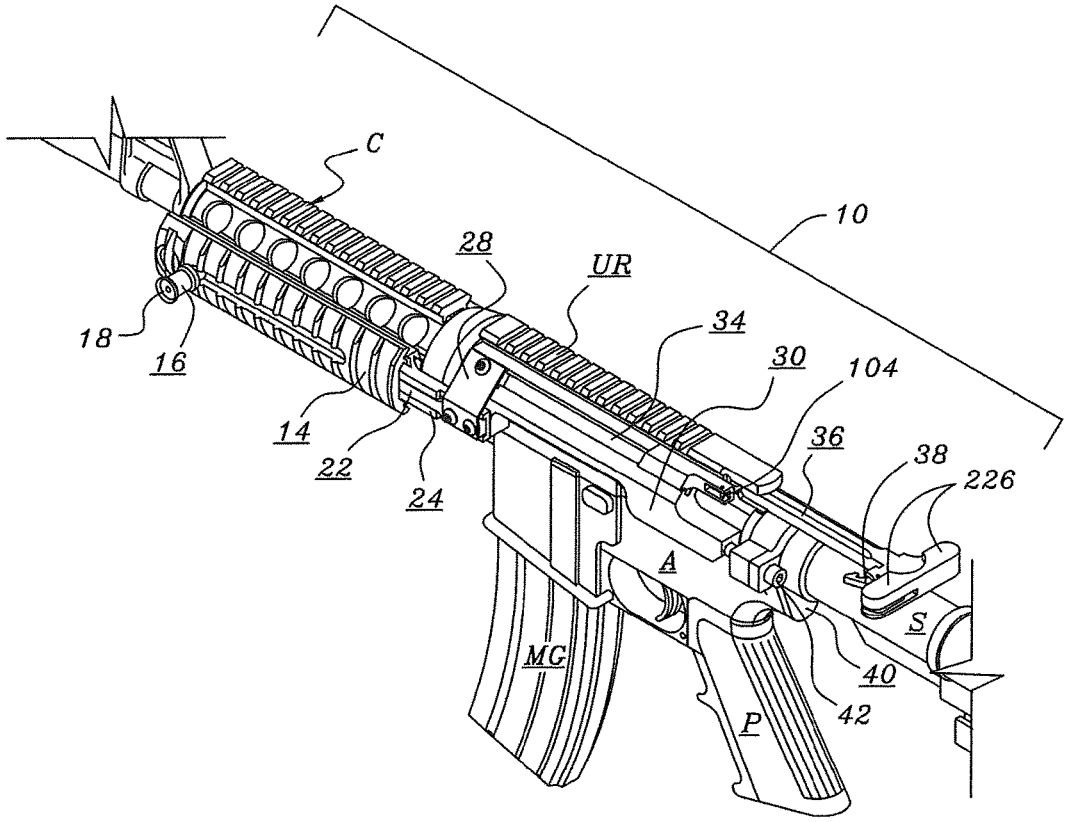

FIG. 2G is a left perspective view of the actuation of handle 36 separate from charger 10. FIG. 2G is an enlarged view with charger 10 in its mounted position, including mount C, lower receiver A, ammunition magazine MG, upper receiver UR, pistol grip P, stock S, and charger 10.

Charger 10 includes foregrip 14, auxiliary handle 16, auxiliary screw 18, primary bracket 24, primary link 22, coupling bracket 28, secondary link 34, secondary bracket 30, latch 38, handle 36, stock bracket 40, and stock pin 42 (FIG. 2). In this view, as in FIGS. 2, 2E, and 2F, ammunition magazine MG is shown mounted in lower receiver A.

To utilize charger 10 (FIG. 2F), auxiliary handle 16 is grasped and pulled to the rear. The rearward force is transferred to handle 36 by primary link 22 and secondary link 34, which are joined by coupling bracket 28 (FIGS. 2B, 2C, 2D, and 2E). Handle 36 is operated from handle 16 (FIG. 2E) while in any position. This flexibility gives the operator the ability to keep their dominant hand on pistol grip P, giving them complete control of the rifle.

The position of handle 36 (FIG. 2F) by handle 16 is decided by the operator. Using handle 16 the operator can partially or fully pull the bolt of the rifle back from its home position to check the chamber or operation of the rifle. In any of the manipulated positions the components of charger 10 are sent back to their home position by a forward force provided by a recoil buffer spring 270 housed in stock S. The operator has only to release auxiliary handle 16 to allow the components to be returned home, requiring no further action. In prior art firearm modification assemblies, the operator must manually return the components back to their home position. This forward movement requires additional mental and physical tasks, which in turn divides their attention. However, here the operator can also return the components of charger 10 back to their home position by hand. To do this, the operator pushes auxiliary handle 16 forward until it is in its home position.

FIG. 2F also shows that charger 10 has an ergonomic forward actuation point 272 as well as the original rear actuation point 274. Having two operation points provides more flexibility and reliability over prior art of similar nature.

FIG. 2G shows handle 36 being operated separately from charger 10 and in its rearmost position. As originally designed, handle 36 is grasped at gripping points 226, releasing latch 38 from pin 104 and pulled to the rearmost position (FIG. 2G). Handle 36 operates independently of the components of charger 10 (FIGS. 2D and 2E).

Handle 36 is sent back to its home position by a forward force provided by the recoil buffer spring 270. This happens when the operator releases the rearward force from handle 36.

The ability to operate handle 36 independently is important. Not only does it give the operator a second point to actuate the bolt of the rifle, but it also acts as a counter measure if charger 10 becomes damaged or has a failure.

Prior art firearm modification assemblies did not have the ability to operate separately. The forward handle was tied to the charging handle via a mechanical linkage. This can be a problem if the components become broken or damaged, possibly preventing the rifle from functioning properly.

First Alternative Embodiment

Figure 3:
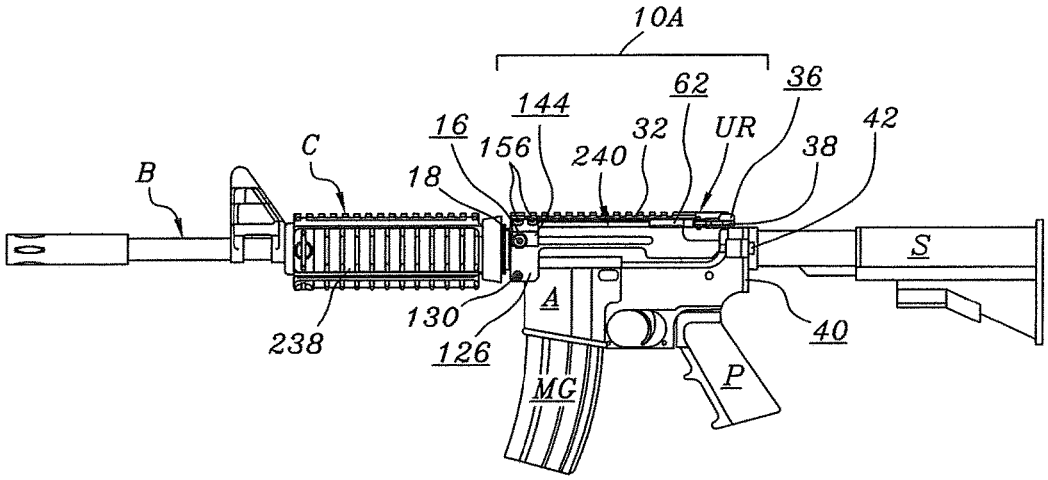
FIGS. 3 through 3C are left elevation and left perspective views, in both exploded and assembled representations, respectively, of one aspect of a second embodiment of an AR15 type rifle with a modification for actuating the primary charging handle or bolt of a firearm.
Figure 3A:
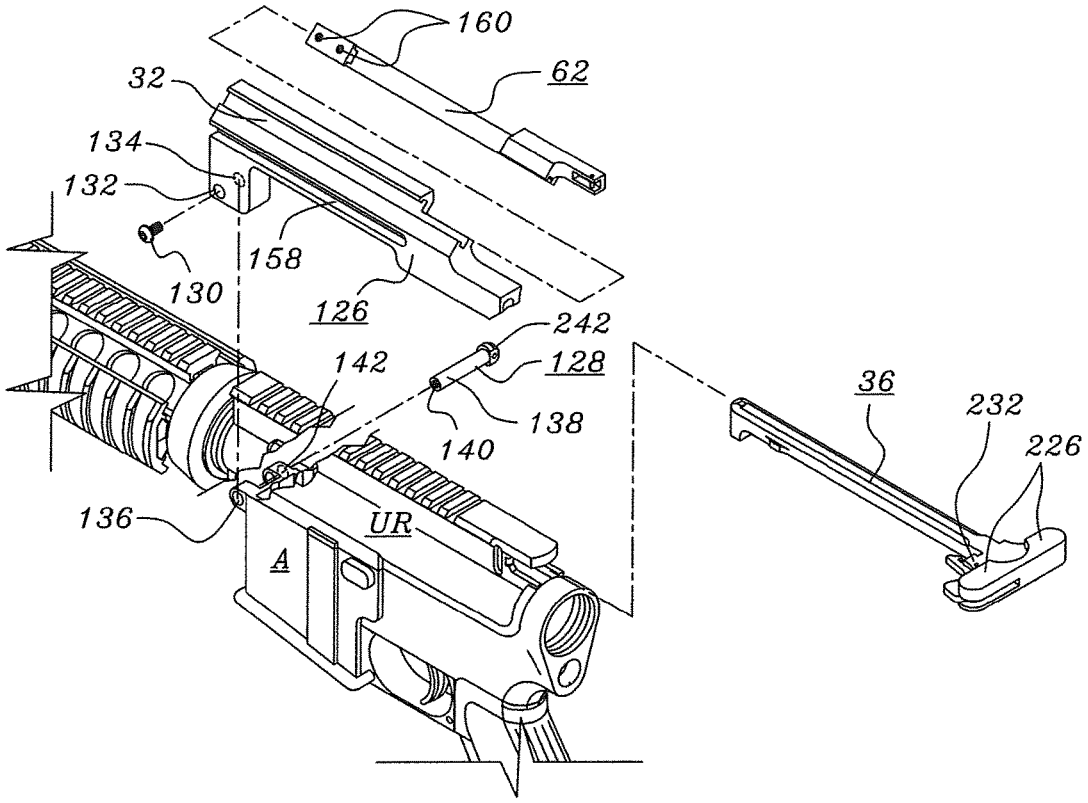
Figure 3B:
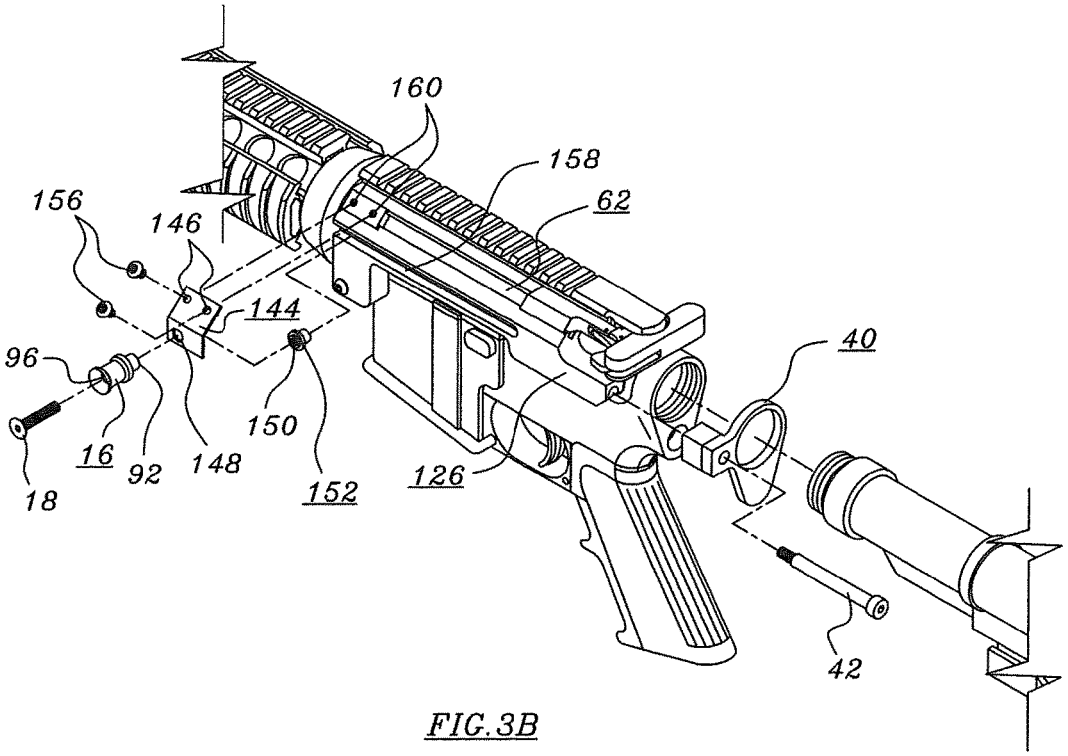
Figure 3C:
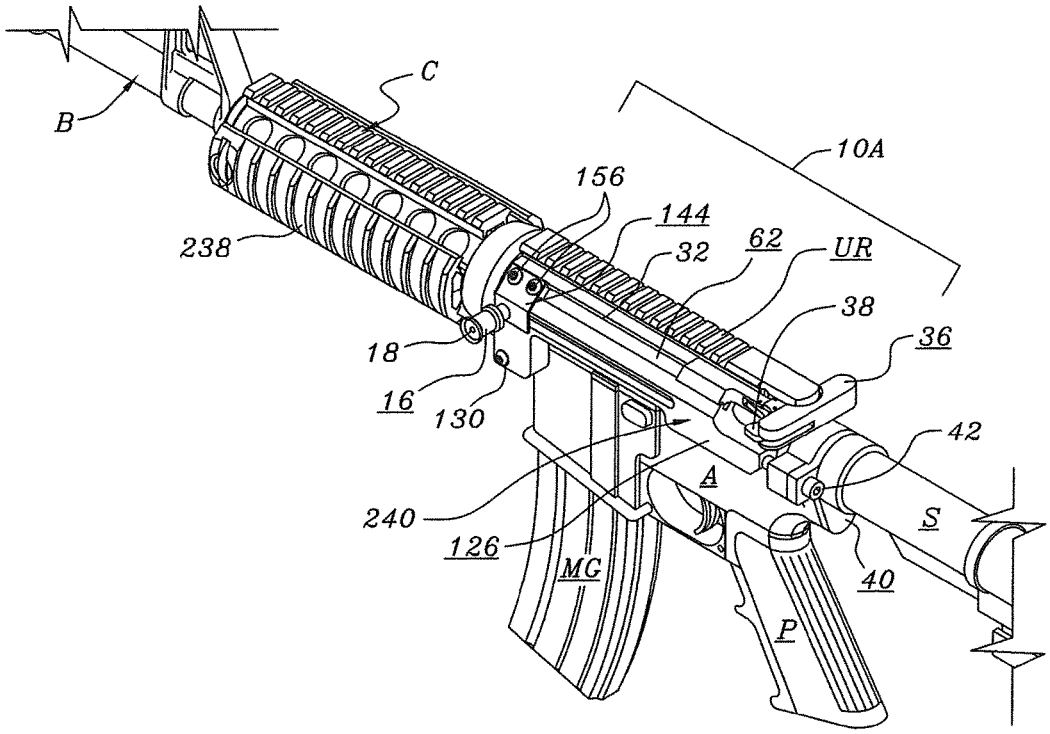

FIG. 3 is a left elevation view and FIG. 3C is a left perspective view of a multi-cocking handle charger 10A in accordance with a first alternative embodiment. This embodiment reduces the number of components needed. It also relocates an auxiliary operation point for the bolt of the rifle to a new location at the midsection of the rifle. This allows the operator to use the forward section of the rifle for general purposes but still have the benefit of the multiple cocking points. The rifle has stock S, pistol grip P, lower receiver A, ammunition magazine MG, upper receiver UR, barrel B, and mount C with a non-modified foregrip 238. Charger 10A includes an alternative bolt actuator 240 between mount C and handle 36.

Charger 10A includes bolt actuator 240, auxiliary handle 16, an alternative link 62, stock bracket 40, and stock pin 42.

Actuator 240, which includes an alternative bolt actuator bracket 126, auxiliary handle 16, auxiliary screw 18, an alternative coupling 144, and link 62. Bracket 126 is mounted against upper receiver UR at a forward and rear point and supports link 62. Bracket 126 is mounted in its forward point by a cylindrical, front pivot pin 128 (FIG. 3A) and a front pivot pin retaining screw 130.

Alternative bracket 126 has a low profile and a mostly rectangular shape and is rigidly mounted against upper receiver UR. It is mounted at its rear point by stock bracket 40 and stock pin 42, as used in the embodiment of FIGS. 2-2G.

Bracket 126 supports and guides thin, rectangular link 62 by a longitudinal T-shaped secondary slot 32.

The front portion of link 62 is a formed rectangular sheet-metal coupling 144 which is mounted by two spaced coupling bracket screws 156. Coupling 144 is used to aid in the transfer of motion from the operator to handle 36.

Auxiliary handle 16 is mounted to coupling 144 by auxiliary screw 18. Screw 18 is threaded into guide bore 150 of a guide pin 152 (FIG. 3B), which is inserted into lower bore 148 (FIG. 3B) of coupling 144.

Link 62 is coupled to handle 36 by latch 38 (FIGS. 2, 2D, and 2E). Link 62 is the main body that transfers the energy from the operator to handle 36.

Detailed Description—First Alternative Embodiment—FIGS. 3A and 3B FIG. 3A is a partial left perspective, exploded view of a portion of the components used in charger 10A. FIG. 3A shows bracket 126, which is one of the main components of the alternative embodiment of charger 10A. Bracket 126 is manufactured from a rigid material having a basic L-shape and rectangular cross section with various features. This bracket provides the main support for the other components of charger 10A.

The front side of bracket 126 includes the T-shaped secondary slot 32 and a longitudinal guide pin slot 158 having a mostly square profile. Slot 32 and slot 158 in bracket 126 are used to guide and support the motion transferring components of charger 10A.

As shown at the front side of FIG. 3A, at the top of bracket 126, longitudinal, secondary slot 32 can also be seen in the embodiment in FIGS. 2 and 2G were it is used in a similar instance. Secondary slot 32 is preferably formed in the same manner and shape as discussed in connection with FIG. 2B.

Another longitudinal guide slot 158 (FIG. 3A) is formed in bracket 126. Slot 158 has a mostly square profile and is formed in bracket 126 to provide the proper operating depth, distance, and diameter of guide pin 152 (FIG. 3B). Slot 158 is used to aid the guiding and support of auxiliary handle 16 (FIG. 3B).

FIG. 3A also shows the long rectangular component link 62. Link 62 is basically manufactured dimensionally, structurally, and of the same material as secondary link 32 of the embodiment of FIG. 2B. However, alternatively two spaced front boss threaded bore(s) 160 have been added.

Front pin 128 is a cylindrical metal pin having a cylindrical shank 138 and a domed retaining head 242 of a larger diameter at one end. Head 242 has a flat surface formed on one side which is flush with the smaller diameter of the shank. Formed into the center of the flat surface is a small domed indentation. This indentation is used in conjunction with a preexisting detent to retain front pin 128 in place. Pin 128 is a forward anchor body which helps to retain bracket 126 when installed.

Opposite retaining head 242 is a threaded, front pin bore 140. Bore 140 matches the threads formed into front pin screw 130, also seen in FIGS. 3 and 3C.

FIG. 3A also shows T-shaped handle 36 which is modified by extending one side of gripping point 226 and extending latch boss 232 (FIG. 2D).

Bracket 126 is mounted to the rifle by an alternative bracket lower bore 132, front pin 128, and front screw 130. Bracket 126 is placed against upper receiver UR. Then an inside bore 134 is aligned with an existing outside bore 136 of lower receiver A. Once the bores are aligned, the end of front pin 128, having a threaded bore 140, is inserted through a right side lower receiver bore 142 of lower receiver A opposite bracket 126 (FIG. 3A). With the flat surface of front pin 128 facing the rear of lower receiver UR, front pin 128 is pushed through right side bore 142 and outside bore 136 of lower receiver A and upper receiver UR. Front pin 128 is pushed until the small indention of flat surface engages a spring-loaded pin located in lower receiver A (not shown). Once front pin 128 is in place, the threaded portion of front screw 130 is inserted into bore 132 of bracket 126 and into the mating, pin bore 140 of front pin 128 and secured.

Link 62 is installed into bracket 126 in the same manner as the installation of secondary link 34 described in connection with FIG. 2B.

Handle 36 is installed in the same manner as discussed in connection with FIG. 2D (FIG. 2D).

FIG. 3B is a partial left perspective, exploded view of a portion of the components used in charger 10A. FIG. 3B shows components auxiliary handle 16, auxiliary screw 18, coupling 144, guide pin 152, coupling screw 156, stock bracket 40, and stock pin 42.

Handle 16 and screw 18 are the same as those described and seen in FIG. 2C. Stock bracket 40 and stock pin 42 are the same components discussed in connection with FIGS. 2-2G. The new components of the alternative embodiment of FIG. 3B are coupling 144 and guide pin 152. Alternative coupling 144 is a formed, rectangular sheet-metal bracket similar to coupling bracket 28 (not shown) in FIG. 2C. Formed into coupling 144 are alternative coupling bracket upper bores 146. Upper bores 146 will be approximately 0.254 mm larger in diameter than front boss threaded bores 160 of link 62. A lower bore 148 formed into coupling 144 is approximately 0.050 mm to 0.127 mm larger in diameter than the outside diameter of the forward round portion of guide pin 152.

Also, FIG. 3B shows guide pin 152, a metal, cylindrical pin of a predetermined length and varying predetermined diameters. Pin 152 has a guide pin threaded bore 150 of a predetermined diameter located through its cylindrical centerline.

In the embodiment of FIG. 3B, handle 16 is mechanically fastened to coupling 144 by screw 18 and guide pin 152. The forward portion of pin 152 is inserted into lower bore 148 of coupling 144 from the back side (FIG. 3B). Rear end 92 of auxiliary handle 16 is aligned with front portion of pin 152 that is inserted in lower bore 148 of coupling 144. Once the bores are aligned, the threaded shaft of screw 18 is inserted into auxiliary handle bore 96 of handle 16 and into guide bore 150 of pin 152. Screw 18 is then threaded into threaded, guide bore 150 of pin 152 and secured. Pin 152 helps distribute forces applied to handle 16 by the operator to prevent the binding of link 62 when moving within bracket 126.

With handle 16 and guide pin 152 attached to coupling 144, the assembled components are put in place on link 62. The assembled components are installed by aligning, upper bores 146 of coupling 144 with the front boss bores 160 of link 62. While aligning upper bores 146 with front boss bores 160, pin 152 is also aligned and put in place in guide pin slot 158 located in bracket 126. With upper bores 146 aligned and pin 152 in place, the threaded shaft of coupling screw 156 is placed though upper bore 146 and threaded into front boss bores 160. This is repeated until both coupling screws 156 are installed and secured.

The alternative embodiment in FIG. 3B will be secured in the back portion of bracket 126. The components used will be the same as that of the embodiment of FIGS. 2-2G. These components are stock bracket 40 and stock pin 42 (FIG. 2D).

FIGS. 3 and 3C shows charger 10A in accordance with the alternative embodiment mounted to the rifle. With actuator 240 rigidly in place against upper receiver UR of the rifle, to actuate handle 36 of the rifle using charger 10A, auxiliary handle 16 is grasped and pulled rearward. Handle 16 is secured in place to coupling 144 by auxiliary screw 18 and guide pin 152 (FIG. 3B) transfers the rearward force to coupling 144.

Coupling 144 is attached to link 62 by two coupling screws 156 moves link 62 to the rear within bracket 126. As this rearward movement of link 62 occurs, handle 16 is also guided by guide pin 152 (FIG. 3B) in guide slot 158.

Bracket 126 does not move during the transfer of the rearward force because it is anchored at the front by front pin 128 (FIG. 3B) and to the rear by stock bracket 40 and stock pin 42 (FIG. 2D for more detail on stock bracket 40 and stock bracket pin 42).

With bracket 126 secured, the rearward force continues through link 62. Link 62 is coupled to handle 36 by latch 38, which moves handle 36 to the rear, cocking the bolt of the rifle.

As with the embodiment of FIG. 2E, the existing recoil-buffer spring 270 of the rifle provides a forward opposing force which returns the components of the embodiment of charger 10A back to their home position when the rearward force is released (FIGS. 2E and 2F). Also, as with the embodiment of charger 10, handle 36 may be actuated totally independent of charger 10A (FIG. 2G). As stated earlier in connection with FIG. 3, charger 10A gives the operator the option of multiple points to cock the rifle and the ability to fully utilize the mounting system of mount C, located at the front of the rifle.

Second Alternative Embodiment

Figure 4:
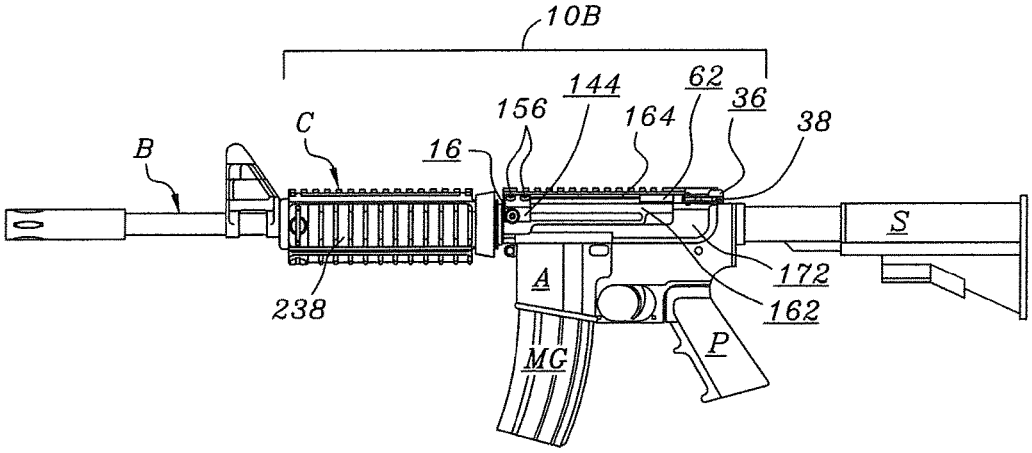
FIGS. 4 through 4C are left elevation and left perspective views, in both exploded and assembled representations, respectively, of one aspect of a third embodiment of an AR15 type rifle with a modification for actuating the primary charging handle or bolt of a firearm t.
Figure 4A:
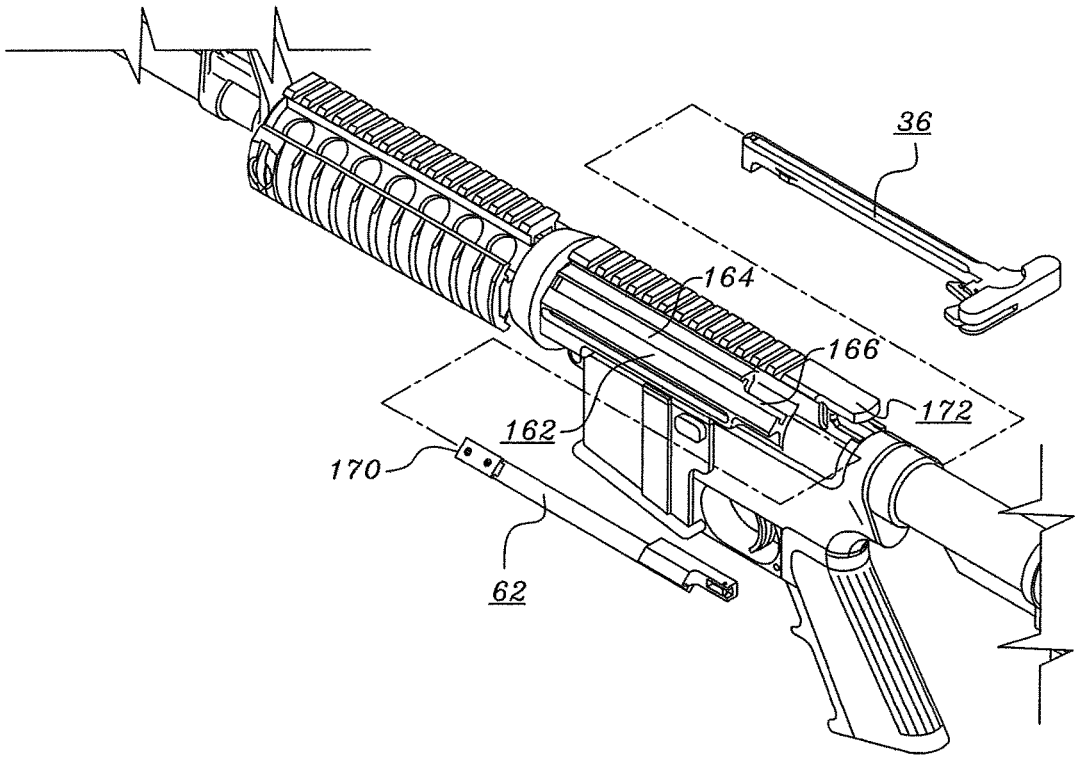
Figure 4B:
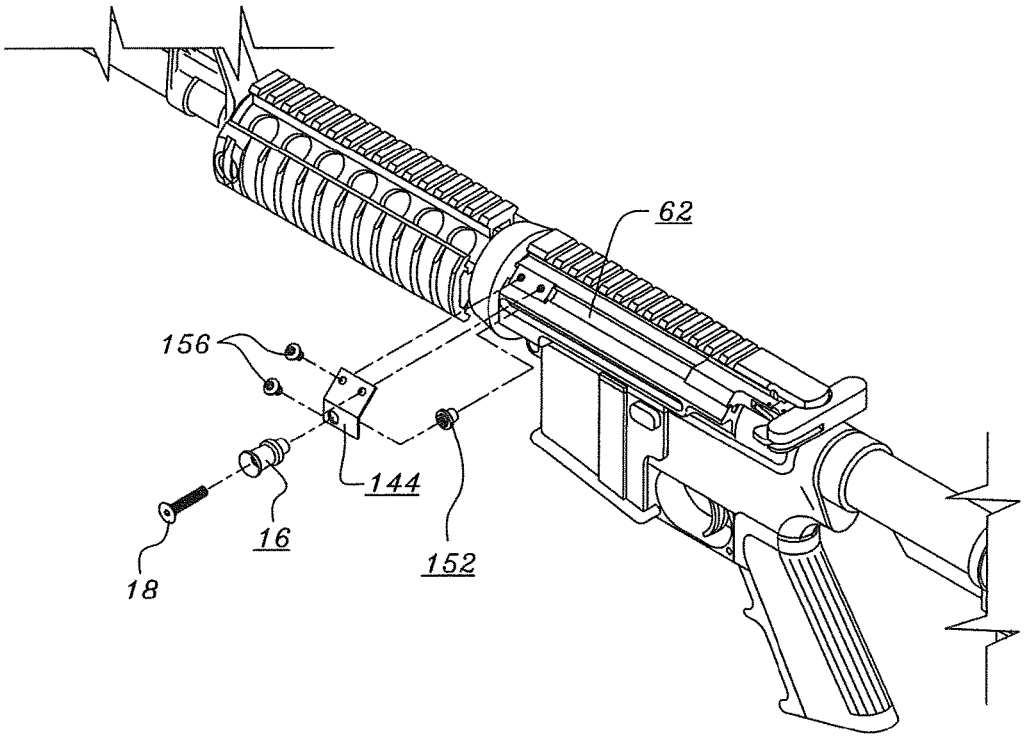
Figure 4C:
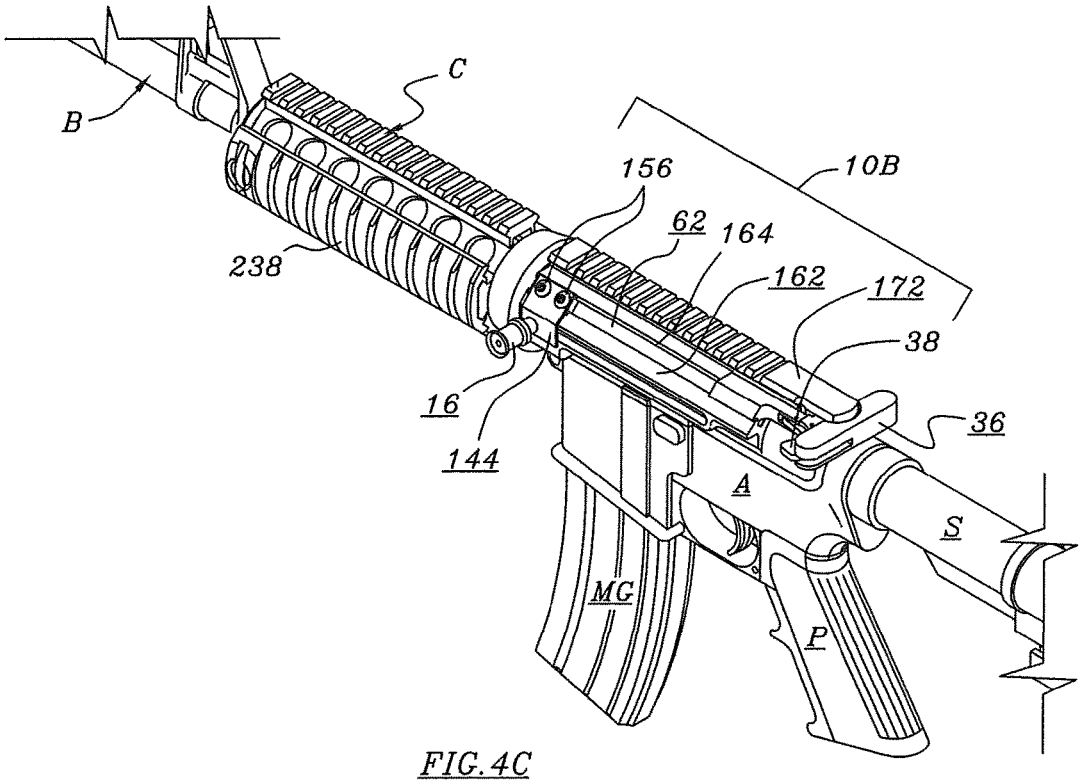

FIG. 4 is a left elevation view and FIG. 4C is a left perspective view of a multi-cocking handle charger 10B in accordance with second alternative embodiment. Charger 10B reduces the number of components needed. As with charger 10A, this embodiment relocates an auxiliary operation point for handle 36 to a new location at the midsection of the rifle. This embodiment also allows the operator to use the forward section of the rifle for general purposes while still having the benefit of the multiple cocking points. The rifle has stock S, pistol grip P, lower receiver A, ammunition magazine MG, barrel B, and mount C with a non-modified foregrip 238.

Charger 10B includes a modified receiver 172 installed between mount C and handle 36. The components of charger 10B include modified receiver 172, receiver coupling 144, auxiliary handle 16, and alternative link 62.

The elongated, mostly cylindrical modified receiver 172 supports link 62 in position, replacing the standard upper receiver of the rifle. Modified receiver 172 supports and guides link 62 by a longitudinal alternative link boss slot 164 (FIG. 4A) formed into an alternative link boss 162.

The front portion of link 62 is mounted to coupling 144 by two spaced coupling screws 156.

Handle 16 is mounted to coupling 144 in the same manner as seen and described in FIG. 3B (FIG. 3B and FIG. 4B). Link 62 is coupled with handle 36 by latch 38 (FIGS. 2D, 2E, 3B, and 3C).

In further detail, FIG. 4A is a partial left perspective, exploded view of a portion of the components used in charger 10B. FIG. 4A shows link 62 and modified receiver 172 installed on the rifle.

Receiver 172 is an elongated, mostly cylindrical firearm receiver with a center through bore, having thickened bosses formed on it for mounting accessories. Receiver 172 is manufactured in the same manner as the standard upper receiver UR of FIGS. 2 and 3, with the addition of alternative link boss 162. Receiver 172 is constructed either by casting, forging, machining, etc., out of ordnance-grade aluminum. A thickened, boss 162 is added to the left side of the standard upper receiver by design and is finished machined to the correct dimensions needed for functioning. Boss 162 has the same dimensional slots and features formed into it as alternative bracket 126 of FIG. 3, so it can guide and support link 62.

Link 62 is installed by aligning a forward-portion 170 of link 62 with a rear-portion 166 of alternative slot 164 formed into boss 162. Link 62 is then slid forward in alternative slot 164 until it stops in its home position. With link 62 installed in boss 162 of receiver 172, handle 36 of the rifle is installed (FIG. 2D or FIG. 3A).

FIG. 4B is a partial left perspective, exploded view of a portion of the components used in charger 10B. The components of charger 10B shown in FIG. 4B include auxiliary handle 16, auxiliary screw 18, coupling 144, guide pin 152, and coupling screws 156.

Handle 16 and screw 18 of charger 10B, are the same as those discussed in FIGS. 2C and 3B. Coupling 144 is the same component used in the first alternative embodiment of FIG. 3B (FIG. 3B). Also, FIG. 4B shows guide pin 152. Guide pin 152 is the same component used in FIG. 3B.

Handle 16 is mechanically fastened to coupling 144 by screw 18 and guide pin 152 (FIG. 3B).

Handle 16, coupling 144, and guide pin 152 are assembled and mounted to link 62 in the same manner as discussed in FIG. 3B.

FIGS. 4 and 4C show charger 10B mounted on the rifle in accordance with the second alternative embodiment. As with other embodiments, charger 10B can be operated by either auxiliary handle 16 or handle 36. Auxiliary handle 16 or handle 36 is actuated, as with the other embodiments, by the operator grasping and pulling rearward (FIG. 2E, 2F, or 3C). The main difference is the exclusion of the exterior mounting accessories front pin 128, front screw 130, stock bracket 40, and stock pin 42, (FIG. 3B). Also excluded is alternative bracket 126 (FIG. 3B) since modified receiver 172 has a support for alternative link 62 formed into it. FIGS. 4 and 4C thus show a simplified and more robust design for manufacturing as well as maintaining in the harsh environment of field use. As with FIG. 3, the operator retains the ability to fully utilize mount C to mount other commercially available options as it is intended.

Third Alternative Embodiment

Figure 5:
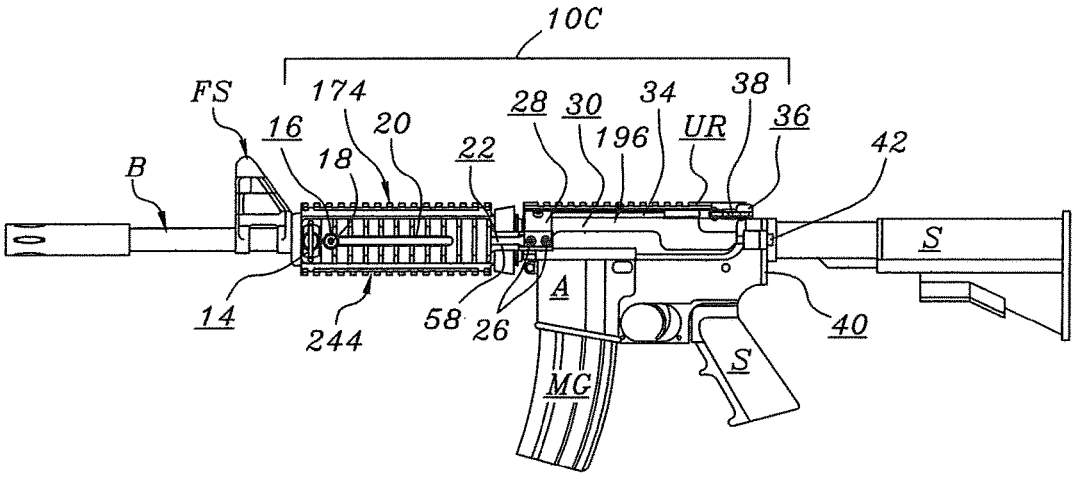
FIGS. 5 through 5B are left elevation and left perspective views, in both exploded and assembled representations, respectively, of one aspect of a fourth embodiment of an AR15 type rifle with a modification for actuating the primary charging handle or bolt of a firearm.
Figure 5A:
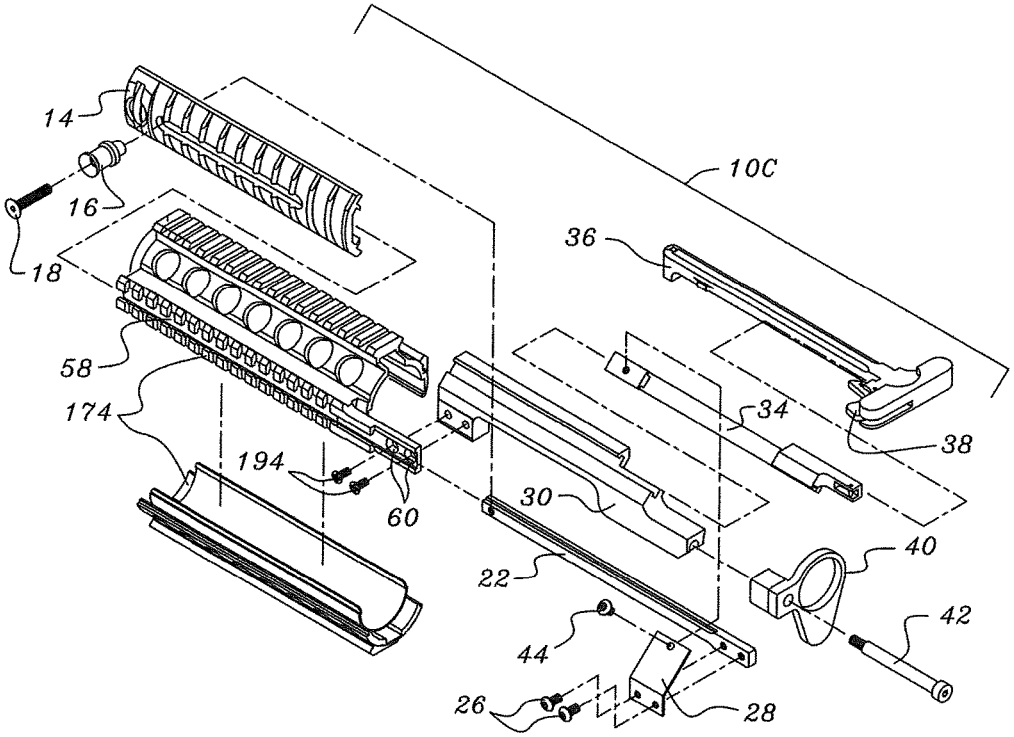
Figure 5B:
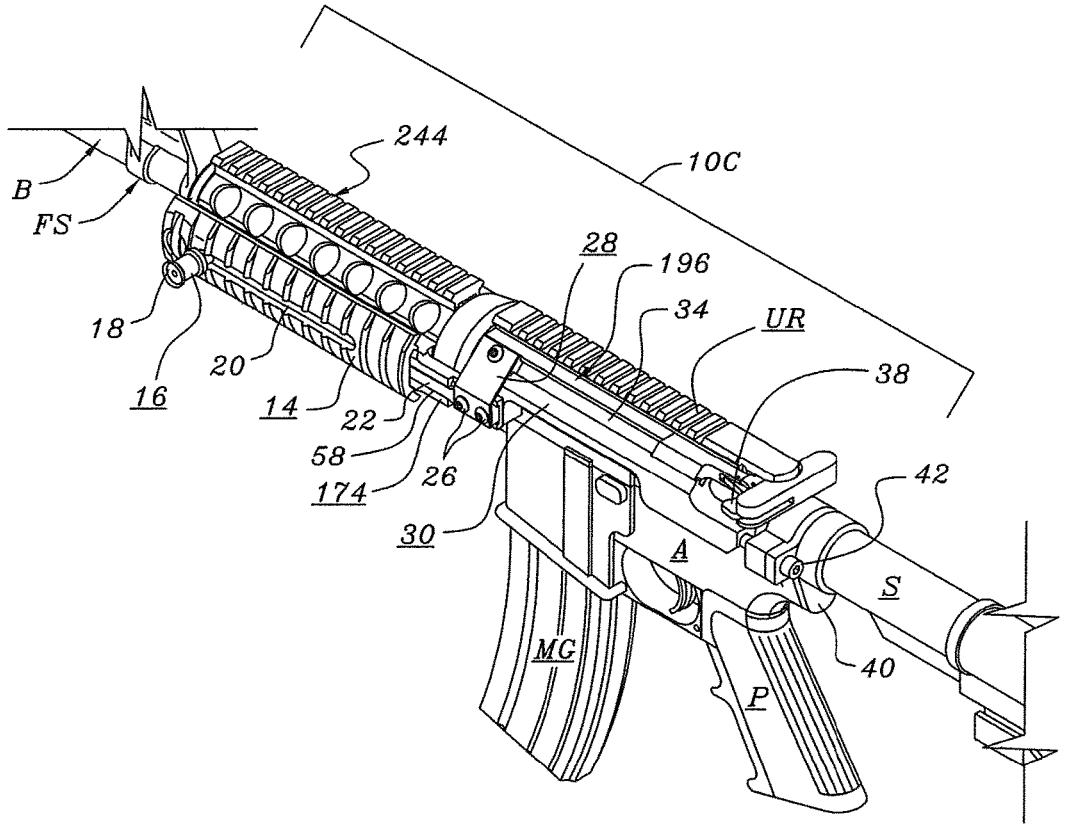

FIG. 5 is a left elevation view and FIG. 5B is a left perspective view of a multi-cocking handle charger 10C in accordance with third alternative embodiment. Charger 10C, like charger 10, adds an auxiliary forward operation point for handle 36 of the rifle. The operator can now choose either the primary or auxiliary point to cock the rifle. This embodiment reduces the number of components needed. FIGS. 5 and 5B show the rifle's stock S, pistol grip P, lower receiver A, ammunition magazine MG, upper receiver UR, barrel B, and a front sight FS. Charger 10C includes an integrated alternative bolt actuator 244 and secondary actuator 196 mounted between front sight FS and handle 36 of the rifle.

The shape of integrated actuator 244 is defined by a modified rail-type mount 174. Mount 174 is a two piece, elongated mounting structure with a mostly octagonal profile having a cylindrical bore through its center. The components included in actuator 244, along with mount 174, are primary link 22, coupling bracket 28, and auxiliary handle 16. Mount 174 supports and guides link 22 by a longitudinal, primary slot 58 (FIG. 5A). Coupling bracket 28 is mounted to the rear end portion of link 22 by using two spaced lower coupling screws 26 (FIG. 2C or FIG. 5A).

Also, foregrip 14 is shown in place on mount 174. Foregrip 14 is mounted in the same manner as explained in FIG. 2. A longitudinal foregrip slot 20 allows the operation and installation of handle 16. Handle 16 is shown in FIGS. 5 and 5B in its home position and fastened to the forward portion of link 22 by auxiliary screw 18 (FIG. 2C and FIG. 5A).

Continuing in FIGS. 5 and 5B, secondary actuator 196 includes a secondary bolt actuator bracket 30 and a secondary link 34.

Secondary actuator 196 is rigidly mounted along upper receiver UR of the rifle by two mechanical connections. As in FIG. 2, the forward connection is made by connecting the rear end portion of mount 174 to the forward portion of secondary bracket 30 with two undercut screws 194 (FIG. 2B or FIG. 5A).

After mount 174 and secondary bracket 30 have been joined, the second mechanical connection is made at the rear portion of secondary bracket 30 by rear bore 116 (FIG. 2B), stock bracket 40, and stock pin 42 (FIG. 2D and FIG. 5A). This is done to fully secure charger 10C to the rifle.

After mount 174 of actuator 244 and secondary bracket 30 of actuator 196 are mounted in place, the actuators are coupled together. The two actuators are coupled in the same manner as the similar components of the embodiment of FIG. 2 (FIG. 2C).

Handle 36 is held in place against rear portion of link 34 by latch 38 mounted within handle 36 (FIGS. 2, 3, and 4). As in the previous embodiments, until released latch 38 ties handle 36 into charger 10C while in operation or at home.

In further detail, FIG. 5A is a partial left perspective, exploded view of charger 10C and modified rail mount 174 in accordance with the third embodiment.

FIG. 5A shows two prior components combined into one. Primary bracket 24 and mount C (FIGS. 2-2E) are integrated. One side of mount C (FIGS. 2-2E) is modified by lengthening and thickening to a predetermined dimension to match that of primary bracket 24 installed on mount C (FIG. 2B). This is done to eliminate the need for component primary bracket 24, as seen FIGS. 2-4C. Also with the addition of the material to mount C, features such as primary slot 58, countersunk bores 60, etc., can be formed directly in to modified rail mount 174 (FIGS. 2A and 2B). Combining these features and components in to mount 174 will reduce the number of pieces needed for charger 10C.

Even though modified rail mount 174 (FIG. 5A) is shown having top and lower halves, mount 174 can be manufactured in multiple or in one-piece designs.

All other components shown in FIG. 5A, such as link 22, handle 16, handle 36, link 34, secondary bracket 30, latch 38, stock pin 42, stock bracket 40, undercut screws 194, upper screw 44, bracket screws 26, coupling bracket 28, foregrip 14, screw 18, etc., are identical to those used in other embodiments (FIGS. 2-4C).

The alternative embodiment of charger 10C, described in FIGS. 5 and 5B, will function in the same manner as described in the previous embodiments but with fewer parts.

Fourth Alternative Embodiment

Figure 6:
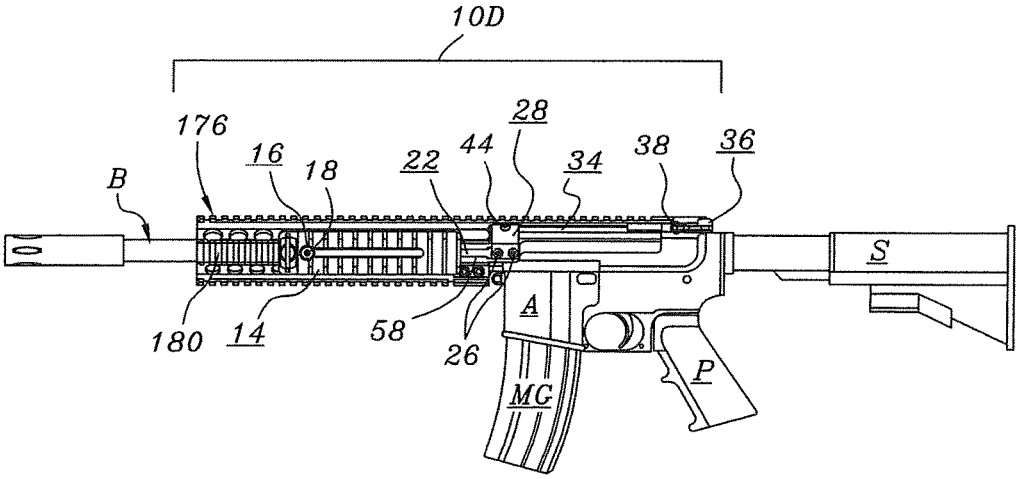
FIGS. 6 through 6C are left elevation and left perspective views, in both exploded and assembled representations, respectively, of one aspect of a fifth embodiment of an AR15 type rifle with a modification for actuating the primary charging handle or bolt of a firearm.
Figure 6A:
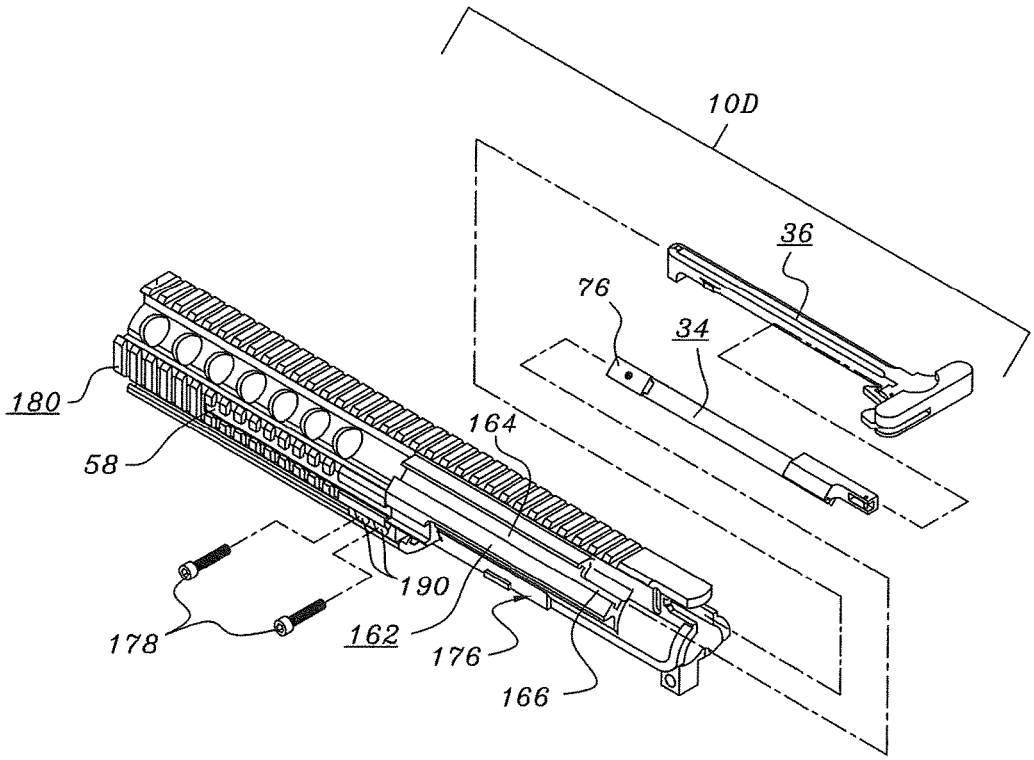
Figure 6B:
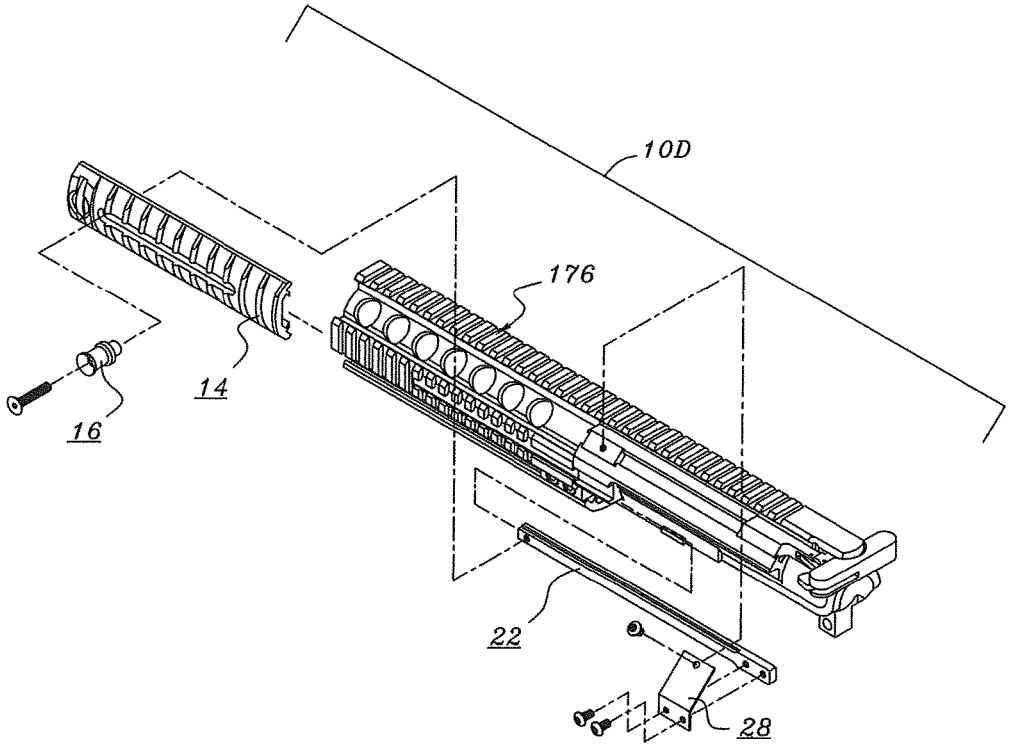
Figure 6C:
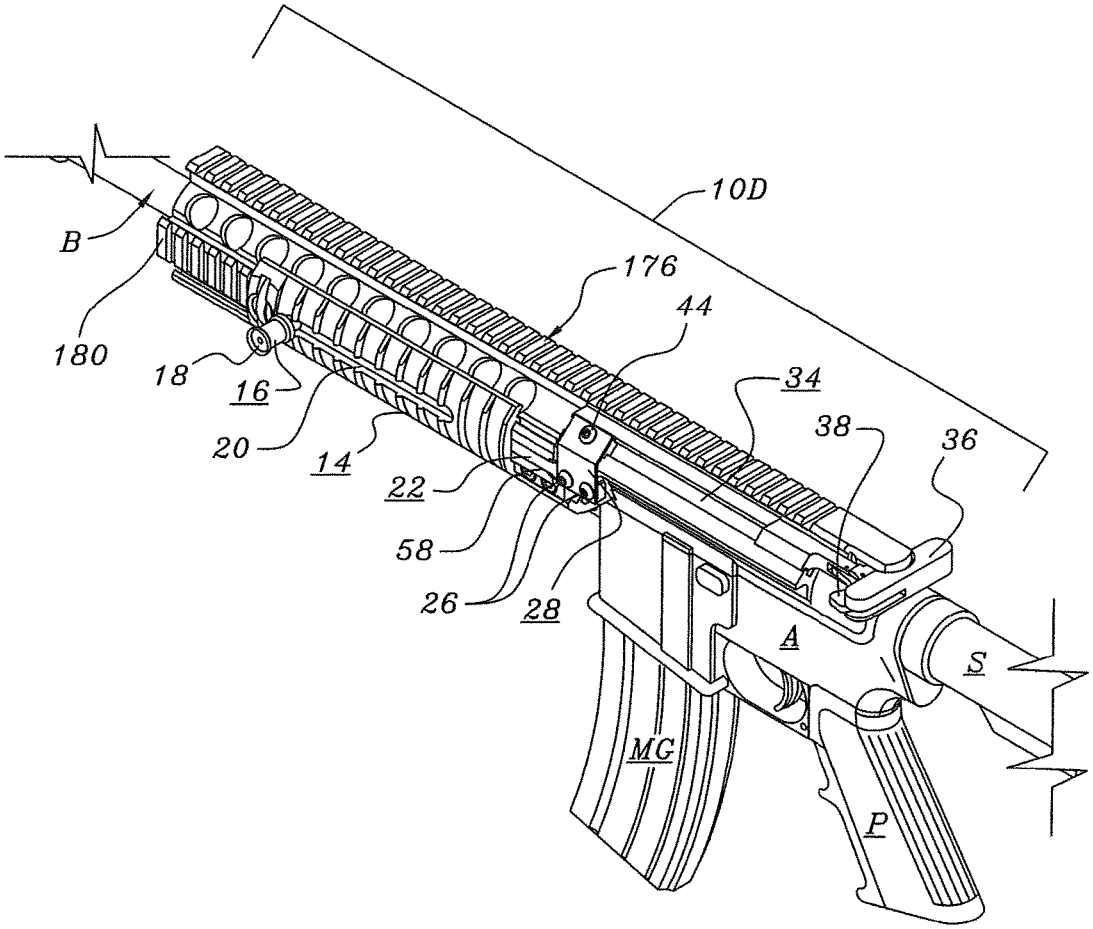

FIG. 6 is a left elevation view and FIG. 6C is a left perspective view of a multi-cocking handle charger 10D in accordance with a fourth alternative embodiment. Charger 10D, like the other alternative embodiments of charger 10, adds an auxiliary operation point for handle 36. Charger 10D also integrates many of the mounting and structural components of the alternative embodiment with the receiver. This turns the receiver and the structural components into a one-piece component. This embodiment again reduces the number of components. With the addition of the auxiliary operation point the operator can now choose either the primary or auxiliary point to cock the rifle. The rifle has a stock S, pistol grip P, lower receiver A, ammunition magazine MG, barrel B, and a one-piece, integrated receiver 176 mounted on lower receiver A.

The components of this embodiment are integrated receiver 176, auxiliary handle 16, auxiliary screw 18, modified foregrip 14, primary link 22, coupling bracket 28, secondary link 34, and handle 36.

Integrated receiver 176 is an elongated metal component having an octagonal profile with a cylindrical bore through its center. It is shown in position with barrel B installed and supporting and guiding links 22 and 34. Receiver 176 replaces the standard upper receiver of the rifle. Links 22 and 34 are guided and supported by a longitudinal T-shaped primary slot 58 formed into a slim, rectangular, side accessory mount 180 (FIG. 6B) of receiver 176.

A coupling bracket 28 is mounted to the rear portion of link 22 by two spaced lower coupling screws 26. Bracket 28 is also fastened to front portion of link 34 by screw 44, combining links 22 and 34 together as a rigid unit (FIG. 2C). These joined components are used to linearly transfer motion from handle 16 to handle 36 to cock the rifle.

Also foregrip 14 is shown in place on side accessory mount 180 of receiver 176. Foregrip 14 is mounted in the same manner as explained in connection with FIG. 2. A longitudinal foregrip slot 20 in foregrip 14 allows the operation and installation of handle 16. Handle 16 is shown in FIGS. 6 and 6C in its home position and fastened to the forward portion of link 22 by auxiliary screw 18 (FIGS. 2C, 5A, and 6C).

As in the other embodiments, handle 36 is held in place in operation and at rest against rear portion of link 34 by latch 38 (FIG. 2B).

In further detail, FIG. 6A is a left perspective, exploded view of the components used in integrated receiver 176 and charger 10D, showing integrated receiver 176, secondary link 34, a barrel retaining screw(s) 178, and handle 36.

Receiver 176 is a one-piece, integration of mount C, primary bracket 24, secondary bracket 30, and firearm upper UR (FIGS. 2-2E).

Receiver 176 is manufactured by forging, casting, injection molding, machining, etc., a suitable material, such as aluminum, titanium, alloy steel, polycarbonate, etc. It is then finished machined to predetermined specifications.

As seen in FIG. 6A, integrated receiver 176 has a primary slot 58 formed into one or both side accessory mount 180 mounting rails to guide and support primary link 22 (FIG. 6B). Also, formed into integrated receiver 176 is an alternative link boss 162 which supports and guides secondary link 34. A similar alternative link boss 162 can be seen and is described in connection with FIGS. 4-4C.

Secondary link 34 is installed by aligning the forward portion 76 of secondary link 34 with rear portion 166 of alternative link slot 164. When aligned link 34 is slid forward until it stops. With secondary link 34 installed, handle 36 is installed as described in connection with previous embodiments (FIGS. 2-5B).

Barrel screws 178, shown in FIG. 6A, are installed after barrel B (FIG. 6) is installed. With barrel B installed, the threaded portion of barrel screws 178 are inserted into a counterbored barrel retaining screw bores 190 located in the lower, mid-section of integrated receiver 176.

FIG. 6B is a left perspective, exploded view of a portion of the components used in integrated receiver 176 and charger 10D. The components of charger 10D shown in FIG. 6B include, primary link 22, coupling bracket 28, modified foregrip 14, and auxiliary handle 16. These components are identical with those prior embodiments (FIGS. 2-2G and FIGS. 5-5B).

In FIG. 6B the components of the alternative embodiment of charger 10D are installed as follows. Integrated receiver 176 is installed in place of standard, upper receiver UR (FIGS. 2-3) on lower receiver A of the rifle. Handle 16, forearm 14, link 22, and bracket 28 are installed as in the prior embodiments described in FIGS. 2 and 5.

Once installed, integrated receiver 176 will function in the same manner as previously described in FIGS. 2-5B. However, even though the alternative embodiment shown in FIGS. 6 and 6C was designed to fit on an AR15-type rifle, other configurations can be manufactured for other firearm types.

The major advantage of this alternative embodiment is the reduction of add-on supports and components. This embodiment has all the advantages of charger 10 and mount C integrated into a one-piece configuration, making it more desirable for the operator and manufacturer.

CONCLUSION

Thus, at least one embodiment of the multi-cocking handle charger provides a more user friendly, flexible, reliable, and ergonomic method to actuate and charge the bolt of firearms. It enhances and hones the abilities of the user and allows the user to feel more confident and less stressed about the rifle, in what can be stressful situations of operation.

While the above descriptions contain many specificities, these should not be construed as limitations on the scope, but rather as an exemplification of several embodiments. Many other variations are possible.

For example, an alternative embodiment which uses a standard forward foregrip that has been modified to act as a means of support, a mounting platform, or a housing for primary bolt actuator 12 or similar device can be used to actuate the bolt of charger 10.

The components can be modified or different fasteners, materials, dimensions, manufacturing techniques, etc. can be used.

Another alternative embodiment can use formed brackets mounted to various areas of the rifle to provide mounting or support points. The formed brackets can be attached, as stated earlier, to various areas of a rifle and used as supports, anchors, or mounting points for the primary or alternative bolt actuator bracket(s).

Charger 10 can be mounted on the opposite side of the rifle as shown in FIGS. 2-6C for a left-handed operator.

Also, charger 10 can employ a vertical foregrip to actuate charger 10. The vertical foregrip can be configured to travel by a track or rail support that can be attached to mount C, to a modified standard foregrip, etc., which is used to actuate primary and alternative bolt actuators. This alternative embodiment can either be an add-on or an integrated support or guide system connected to the primary or alternative bolt actuators. It is contemplated one embodiment would allow the operator to un-latch a catch integrated into the vertical foregrip and move it a predetermined distance. The vertical foregrip would travel along a track, slot, rail, etc., type support with a rearward force applied to the vertical foregrip, thus actuating charger 10 and the bolt as described in previous embodiments.

In another alternative embodiment a standard rifle upper receiver, lower receiver, receiver, frame, etc., can be modified to provide a secondary bolt actuation point. The upper receiver, lower receiver, receiver, frame, etc., can be modified with an opening, which is an access to the rifle's bolt. A secondary-charging handle or connecting rod, linkage, etc., leading to the secondary-charging handle can be affixed so that there is an alternative bolt actuation point. This will allow the elimination of several components as described.

The gas-operated rifle can be modified by using an additive modified foregrip, housing, support, etc. to modify the gas-operating system into a component of charger 10. The gas piston can be used as the primary link, body, connecting rod, etc. The additive foregrip, housing, support, etc., will provide a structure for an auxiliary charging handle to be placed in line with, attached to, placed in front of, etc., the gas piston of the gas operation system. The auxiliary charging handle, once in place, can allow an operator a secondary bolt actuation point, as described.

In another alternate embodiment charger 10 can have a variety of colors or color patterns. Color or color finishes can range from a natural, raw material base color, solid one-color base coloration, multi-color patterns, graphic patterns, etc. These finishes can be applied by painting, pigmentation of materials, an electro-chemical process, powder coating, natural coloration of materials, water-borne graphics, solvent-borne graphics, etc. With the addition of different color finishes, charger 10 can be made to blend in with the surroundings, stand out for cosmetic purposes, act as a protective finish, etc.

An additional actuating point can be provided at the connection point of primary bolt actuator 12 and secondary bolt actuator 196. The other embodiments seen in the FIGS.

2-2G, FIGS. 5-5B, and FIGS. 6-6C can be designed with this additional actuating handle. The handle would be located between the forward, auxiliary actuating handle 16 and rear, primary charging handle 36. This embodiment can have the additional actuating handle installed on or approximately at coupling bracket 28. This extra actuation point would add yet more flexibility to the embodiments of the charger 10.

Accordingly, the scope should be determined not by the embodiments illustrated, but by the appended claims and their legal equivalents.

I claim:

1. A multi-cocking handle charger for actuating a primary charging handle and a bolt of a firearm, comprising:

a primary bolt actuator for actuating the primary charging handle and the bolt, having an auxiliary charging handle and a mounting platform supporting the auxiliary charging handle and attaching the primary bolt actuator to a desired location of the firearm, a secondary bolt actuator adapted to attach to a desired location of the firearm, and having a rear end portion contacting the primary charging handle, and a front end portion coupled to the primary bolt actuator, the mounting platform having a primary bolt actuator bracket having a longitudinal axis, wherein the bracket has a first side having a slot along the longitudinal axis configured to attach the primary bolt actuator bracket to a firearm mount and a second side having a profile along the longitudinal axis defining an accessory mount configured to support accessories, the accessory mount having a primary bolt actuator and auxiliary charging handle operating slot defining a home position and a rearward position along the longitudinal axis, wherein the auxiliary charging handle is arranged such that when the auxiliary charging handle is pulled to the rearward position, the primary bolt actuator and the secondary bolt actuator move the primary charging handle and the bolt to a rearward open position, and upon release of the auxiliary charging handle, a firearm recoil spring within the firearm decompresses to force the auxiliary charging handle and the primary charging handle forward, and wherein said primary charging handle may be moved independently of the auxiliary charging handle.

2. The multi-cocking handle charger of claim 1, further including a coupling bracket for coupling and transferring linear force or motion from the primary bolt actuator to the secondary bolt actuator.

3. The multi-cocking handle charger of claim 1 wherein the secondary bolt actuator includes a secondary bolt actuator bracket adapted to removably attach to the firearm.

4. The multi-cocking handle charger of claim 3, further including a guide for the secondary bolt actuator attached to the secondary bolt actuator bracket.

5. A multi-cocking handle charger for actuating a primary charging handle and a bolt of a firearm, comprising:

an alternative bolt actuator for actuating the primary charging handle and the bolt, having an auxiliary charging handle adapted to transfer force to the primary charging handle, a mounting platform configured to guide and support the auxiliary charging handle and mountable to a desired location of the firearm, the mounting platform having an alternative bolt actuator bracket having a longitudinal axis, wherein the bracket has a first side having a slot along the longitudinal axis configured to attach the alternative bolt actuator bracket to a firearm mount and a second side having a profile along the longitudinal axis defining an accessory mount configured to support accessories, the accessory mount having an alternative bolt actuator and auxiliary charging handle operating slot along the longitudinal axis, wherein the auxiliary charging handle is arranged such that when the auxiliary charging handle is pulled to a rearward position, the alternative bolt actuator moves the primary charging handle to a rearward open position, and upon release of the auxiliary charging handle, a firearm recoil spring within the firearm decompresses to force the auxiliary charging handle and primary charging handle forward, and wherein said primary charging handle may be moved independently of the auxiliary charging handle.

* * * * *